US010674840B2

(12) United States Patent
Haroush

(10) Patent No.: US 10,674,840 B2
(45) Date of Patent: Jun. 9, 2020

(54) MODULAR POWERED SECURE PRODUCT DISPLAY MOUNT

(71) Applicant: Ariel Haroush, Miami, FL (US)

(72) Inventor: Ariel Haroush, Miami, FL (US)

( * ) Notice: Subject to any disclaimer, the term of this patent is extended or adjusted under 35 U.S.C. 154(b) by 0 days.

(21) Appl. No.: 15/726,029

(22) Filed: Oct. 5, 2017

(65) Prior Publication Data

US 2018/0092472 A1 Apr. 5, 2018

Related U.S. Application Data

(60) Provisional application No. 62/404,421, filed on Oct. 5, 2016.

(51) Int. Cl.

| | |
|---|---|
| ***A47F 7/024*** | (2006.01) |
| ***A47F 5/08*** | (2006.01) |
| ***A47F 5/10*** | (2006.01) |
| ***A47F 11/10*** | (2006.01) |
| ***A47F 3/00*** | (2006.01) |
| *A47F 7/00* | (2006.01) |

(52) U.S. Cl.

CPC ..... *A47F 7/024* (2013.01); *A47F 3/002* (2013.01); *A47F 5/0853* (2013.01); *A47F 5/0861* (2013.01); *A47F 5/0869* (2013.01); *A47F 5/0884* (2013.01); *A47F 5/10* (2013.01); *A47F 11/10* (2013.01); *A47F 2007/0085* (2013.01)

(58) Field of Classification Search

CPC ..... A47F 7/024; A47F 3/002; A47F 5/0853; A47F 5/0861; A47F 5/0869; A47F 5/0884; A47F 5/10; A47F 11/10; A47F 2007/0085

See application file for complete search history.

(56) References Cited

U.S. PATENT DOCUMENTS

| | | | | | |
|---|---|---|---|---|---|
| 3,695,452 | A * | 10/1972 | Surman | A47F 7/024 | 206/461 |
| 4,489,995 | A * | 12/1984 | Barr | A47F 3/0447 | 312/116 |
| 4,519,013 | A * | 5/1985 | Breeze | H02B 1/56 | 174/16.1 |
| 4,523,683 | A * | 6/1985 | Fullenkamp | A47B 57/565 | 211/13.1 |
| 4,673,932 | A * | 6/1987 | Ekchian | G01S 13/753 | 235/385 |
| 4,747,025 | A * | 5/1988 | Barton | A47F 5/0846 | 211/94.01 |
| 4,775,921 | A * | 10/1988 | Foley | A47F 5/0846 | 362/147 |

(Continued)

FOREIGN PATENT DOCUMENTS

WO 2014160758 10/2014

OTHER PUBLICATIONS

European Search Report in corresponding application No. 17194846.6 dated Feb. 5, 2018.

*Primary Examiner* — Stanton L Krycinski
(74) *Attorney, Agent, or Firm* — Z IP Law PLLC

(57) ABSTRACT

A display for products, or a mount, or a holder for products, more particularly, but not exclusively, electronic devices, for presentation of electronic products for display or sale and, to a modular system intended to cater for electronic products that may require different power, voltage, and current requirements in order to stay powered while on display in a retail setting.

14 Claims, 19 Drawing Sheets

(56) References Cited

U.S. PATENT DOCUMENTS 4,862,160 A * 8/1989 Ekchian ..... G01S 13/753 340/10.32
4,973,796 A * 11/1990 Dougherty ..... E04B 2/82 174/494
5,142,832 A * 9/1992 Branham, Sr. ..... A47F 5/0846 211/87.01
5,348,485 A * 9/1994 Briechle ..... H01R 25/14 439/110
5,425,648 A * 6/1995 Farham ..... H01R 25/16 439/116
5,644,876 A * 7/1997 Walker ..... A61G 13/107 211/26
5,695,261 A * 12/1997 Slesinger ..... A47F 11/10 312/223.6
5,697,061 A * 12/1997 Krueger ..... G06K 7/0008 455/39
5,816,696 A * 10/1998 Beisler ..... A47F 5/0823 362/396
6,199,705 B1 * 3/2001 Portner ..... A47F 5/0846 211/26
6,283,608 B1 * 9/2001 Straat ..... A47B 97/00 312/223.5
6,527,406 B1 * 3/2003 Slesinger ..... A47F 11/10 312/223.6
6,698,597 B2 * 3/2004 Marihugh ..... A47F 5/04 211/133.1
6,896,145 B2 * 5/2005 Higgins ..... A47F 5/0018 211/1
6,945,414 B1 * 9/2005 Stevens ..... A47F 5/0846 211/183
7,209,038 B1 4/2007 Deconinck et al.
7,249,872 B2 * 7/2007 Ragsdale ..... A47F 7/00 362/432
7,385,522 B2 * 6/2008 Belden, Jr. ..... A47F 5/0861 248/551
7,392,948 B2 * 7/2008 Smith ..... G06Q 10/087 235/383
7,525,487 B2 * 4/2009 Burnside ..... G06K 7/0008 343/700 MS
7,584,016 B2 * 9/2009 Weaver ..... G01G 19/4144 700/213
7,665,860 B2 * 2/2010 Demarest ..... A47F 3/001 312/223.5
8,191,672 B2 * 6/2012 Kondo ..... A47B 49/00 181/125
8,321,304 B2 * 11/2012 Khan ..... G06Q 10/087 211/186
8,629,772 B2 * 1/2014 Valiulis ..... G08B 13/149 340/568.8
8,646,935 B2 * 2/2014 Karan ..... A47F 1/12 362/125
8,749,194 B1 * 6/2014 Kelsch ..... H02J 5/005 320/108
9,149,130 B2 * 10/2015 Yuen ..... A47F 3/001
9,228,735 B2 * 1/2016 Liu ..... A47F 11/10
9,537,275 B2 * 1/2017 Ewing ..... A47F 3/001
9,596,950 B2 * 3/2017 Waalkes ..... F21V 23/001
9,700,157 B2 * 7/2017 Keyvanloo ..... A47F 5/0853
9,782,018 B2 * 10/2017 Hester-Redmond ..... A47F 5/08
10,172,483 B2 * 1/2019 Chen ..... A47B 97/00
2004/0228122 A1 * 11/2004 Slesinger ..... A47F 11/10 362/127
2005/0173605 A1 * 8/2005 Villeneuve ..... A47F 5/0018 248/301
2007/0037559 A1 * 2/2007 Kaiserman ..... G06Q 30/02 455/414.2
2008/0046345 A1 * 2/2008 Serre ..... G06Q 10/087 705/28
2008/0121146 A1 * 5/2008 Burns ..... A47F 5/101 108/23
2008/0192410 A1 8/2008 Kumar
2008/0204672 A1 * 8/2008 Ikeda ..... A47F 3/001 353/78
2009/0020601 A1 * 1/2009 Woodbury ..... G06Q 10/087 235/375
2009/0228795 A1 * 9/2009 Bass ..... G06Q 10/087 715/705
2010/0008072 A1 * 1/2010 Meier-Graichen ..... A47B 97/00 362/127
2010/0175919 A1 * 7/2010 Ellis ..... H01R 25/16 174/481
2011/0073726 A1 * 3/2011 Bergesch ..... H05K 7/183 248/201
2011/0084627 A1 * 4/2011 Sloan ..... F21S 4/20 315/297
2012/0022913 A1 * 1/2012 Volkmann ..... G06Q 10/087 705/7.29
2012/0228240 A1 * 9/2012 Gentile ..... A47F 5/08 211/1
2014/0092531 A1 4/2014 Trinh et al.
2014/0198490 A1 * 7/2014 Halseth ..... A47F 11/10 362/147
2015/0091389 A1 4/2015 Byrne et al.
2017/0198871 A1 * 7/2017 Keenan ..... F21S 8/036
2018/0242761 A1 * 8/2018 Jones ..... A47F 11/10
2018/0255944 A1 * 9/2018 Ford ..... A47F 11/10

* cited by examiner

FIG. 5A
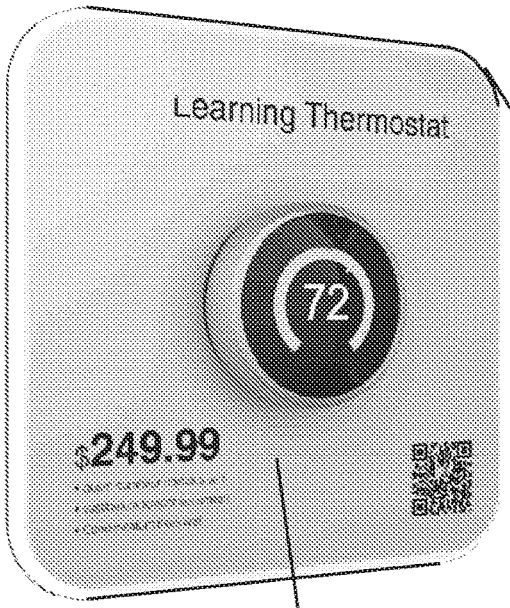
FIG. 5B
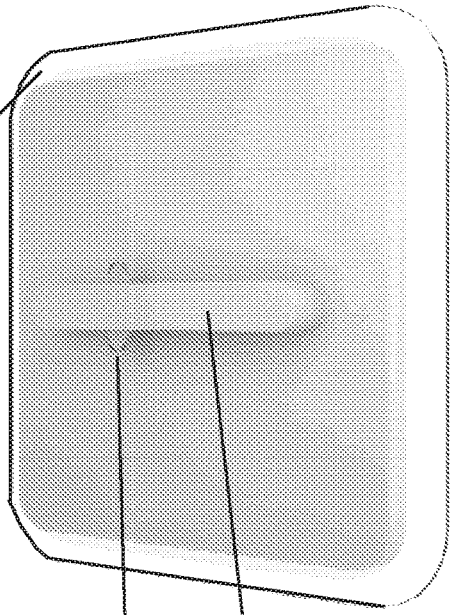
12
10
19
17
12
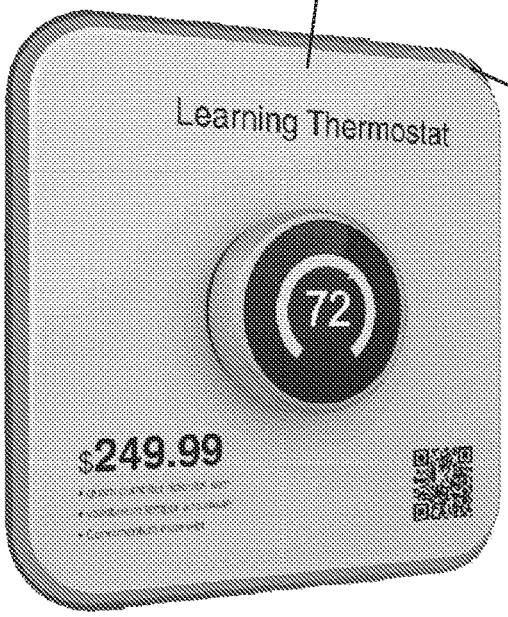
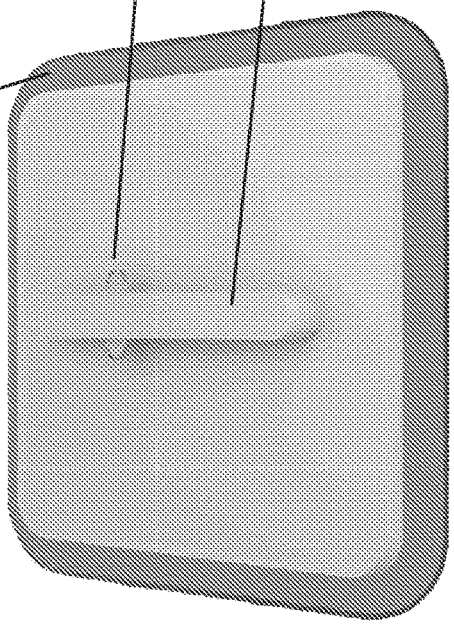
FIG. 5C
FIG. 5D

14

14

SECTION A-A
SCALE 1 : 5

MODULAR POWERED SECURE PRODUCT DISPLAY MOUNT

RELATED PATENT APPLICATION

This application claims the benefit of U.S. Provisional Application No. 62/404,421 filed Oct. 5, 2016 and entitled MODULAR POWERED SECURE PRODUCT DISPLAY MOUNT, which is hereby incorporated herein by reference in its entirety.

FIELD OF THE INVENTION

The present invention, in some embodiments thereof, relates to a display for products, or a mount, or a holder for products, more particularly, but not exclusively, electronic devices, for presentation of electronic products for display or sale and, to a modular system intended to cater for electronic products that may require different power, voltage, and current requirements in order to stay powered while on display in a retail type setting, trade show or other event.

BACKGROUND OF THE INVENTION

A large number of small electronic consumer devices are sold in stores and shops and these devices need electrical power in order to function and for potential customers and purchasers of this product to inspect the functionality of the device.

Current solutions require that each electronic device on display, if it is to be powered, must have its own power connector that may or may not be the same as other products on the same display. For some displays there is no source of electricity so the products are displayed as unpowered which may affect their desirability for sale. In other instances, an individual product display having electricity must be implemented to provide power to each product or product family. The present invention provides a modular product display that uniquely accommodates the powering of electronic products for sale.

SUMMARY OF THE INVENTION

The present invention, is a powered product display system that is attached and powered by a power distribution display surface. The display surface is attached to existing structural surfaces within a building or is held in place by a freestanding structure. The display surface provides a series of slots that each include powered conductors that make contact with a modular power adapter to power electronic components on the product display system and provide power to a product attached for display on the product display system. The product display system has modular components to change product and purchasing information, to provide adequate mounting and support, and to provide proper electrical connectors and power requirements for electronics devices. The product display system is therefore suitable for both electronics devices and non-powered products and provides lighting and flexibility in positioning products within the display surface to best promote the displayed products. Embodiments of the present invention include an on-board computer to receive and transfer data and provide power usage and timing for lighting to reduce power consumption during for example off hours. Embodiments of the product display system may provide a security system in order to prevent the retail theft of products such as small electronic devices. The security system of the present invention will cause an alarm to sound if a product or components of the product display system are removed or tampered with.

The product display system is also unlike current retail displays that do not have the capability to convert standard AC power supplied to different levels of AC power at different frequencies, or to provide DC power at various voltage and current combinations. Unlike these retail displays of the prior art, embodiments of the present invention provide electrical conversion circuits to power an electronic product on display without the use of additional power supplies and/or wiring. Embodiments of the product display system of the present invention may also provide wireless charging capabilities to charge or power a displayed product through the use of an existing wireless standard technology or make use of newly developed wireless power transfer.

Other embodiments of the invention allow for the installation and powering of a display screen within the product display system to display relevant product information. Said display screen may or may not have interactive functionality such as a touch screen, camera, microphone, bar code reader, laser detector, motion, or 3D, or other type electronic sensor for use in interpreting human motion or input and altering the digital contents displayed on the screen accordingly. The present invention is related to a modular product display system, comprising a base unit; a modular power adaptor; a product display plate; and wherein appropriately conditioned power to a product is provided. Embodiments of the modular product display system may comprise a display surface having conductors. Embodiments of the modular product display system may comprise a mechanical locking mechanism and electrical contacts to both mechanically and electrically connect the product display system to the display surface. Embodiments of the modular product display system may comprise an electronic circuit board, the circuit configured to transmit and receive data. Embodiments of the modular product display system may comprise a metallic cover. Embodiments of the modular product display system may comprise a plurality of replaceable mounting plates, each having a specific alignment of posts and screw holes to mate with a product's mounting configuration. In embodiments of the modular product display system the product display plate may be of a flexible and/or magnetic material. The product display plate may comprise at least one from a group consisting of printed graphics, product descriptions, barcodes, purchasing information and other ticketing information. Embodiments of the modular product display system may comprise a plurality of replaceable electrical connectors, each having a specific configuration to mate with a product's electrical connector requirements. Embodiments of the modular product display system may comprise an electrical conversion circuit configured to convert standard AC power supplied to different levels of AC power at different frequencies, or to provide DC power at various voltage and current combinations to match a product's power requirements. Embodiments of the modular product display system may comprise lighting. Embodiments of the modular product display system may comprise a security system that sounds an audible alarm when an electrical disconnection between the product and the modular product display system or between the modular product display system and the powered slot are detected. Embodiments of the modular product display system may comprise a wireless charging antenna that transfers electrical power to the product wirelessly using a conventional wireless standard such a "Qi" or using another, wireless power transfer protocol. Embodiments of the modular product display system may comprise a standard electrical outlet on the product display plate that may be used to power electrical products or electrical components within the product display system.

The present invention is further related to a method of replacing modular components of a product display system, comprising selecting a modular power adaptor configured to meet power requirements of a chosen product for display; affixing the modular power adaptor to a housing; connecting the product electrically to the modular power adaptor. The method of replacing modular components of a product display system may comprise selecting a mounting plate configured to mate with posts and screw hole alignments of a product chosen for display; affixing the mounting plate to the product display system; affixing the product to the product display system using the selected mounting plate. The method of replacing modular components of a product display system may comprise selecting a plate comprising product information specific to a product chosen for display; affixing the plate to the product display system; affixing the chosen product to the product display system. The method of replacing modular components of a product display system may comprise affixing a metallic cover to the modular power adaptor; selecting a plate comprising product information of a flexible magnetic material; affixing the flexible magnetic plate comprising product information to the metallic cover of the modular power adaptor. The method of replacing modular components of a product display system may comprise affixing the product display system to a display surface using a mechanical locking mechanism; and affixing the product display system to a display surface using an electrical connection.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 5A shows an embodiment of a perspective view from the front of the product display system in an illuminated configuration with the product display plate having product information in an embodiment of the present invention;

FIG. 5B shows an embodiment of a perspective view from the back of the product display system in an illuminated configuration in an embodiment of the present invention;

FIG. 5C shows an embodiment of a perspective view from the front of the product display system in a non-illuminated configuration with the product display plate having product information in an embodiment of the present invention;

FIG. 5D shows an embodiment of a perspective view from the back of the product display system in a non-illuminated configuration in an embodiment of the present invention:

DESCRIPTION OF SPECIFIC EMBODIMENTS OF THE INVENTION

The present invention, in some embodiments thereof, relates to a display for products, or a mount, or a holder for products, more particularly, but not exclusively, electronic devices, for presentation of electronic products for display or sale and, to a modular system intended to cater for electronic products that may require different power, voltage, and current requirements in order to stay powered or charged while on display in a retail environment. The product display system of the present invention is further modular to swap components to display different product information and provide different layouts for attaching a product to the display.

Figure 1A:
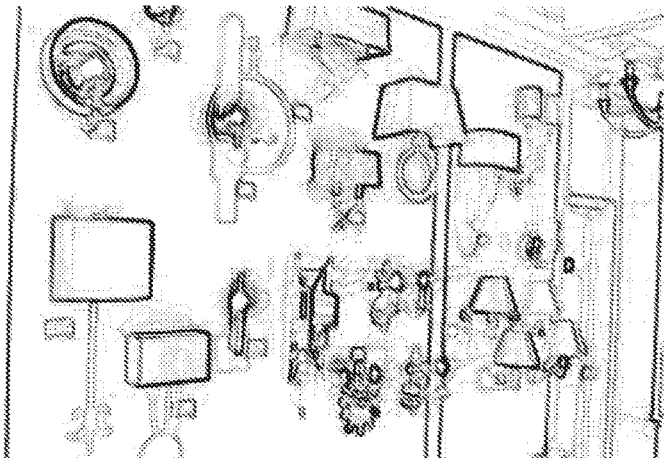
FIG. 1A (PRIOR ART)
FIGS. 1A-1B show a selection of product displays and powered tracks of the prior art.
Figure 1B:
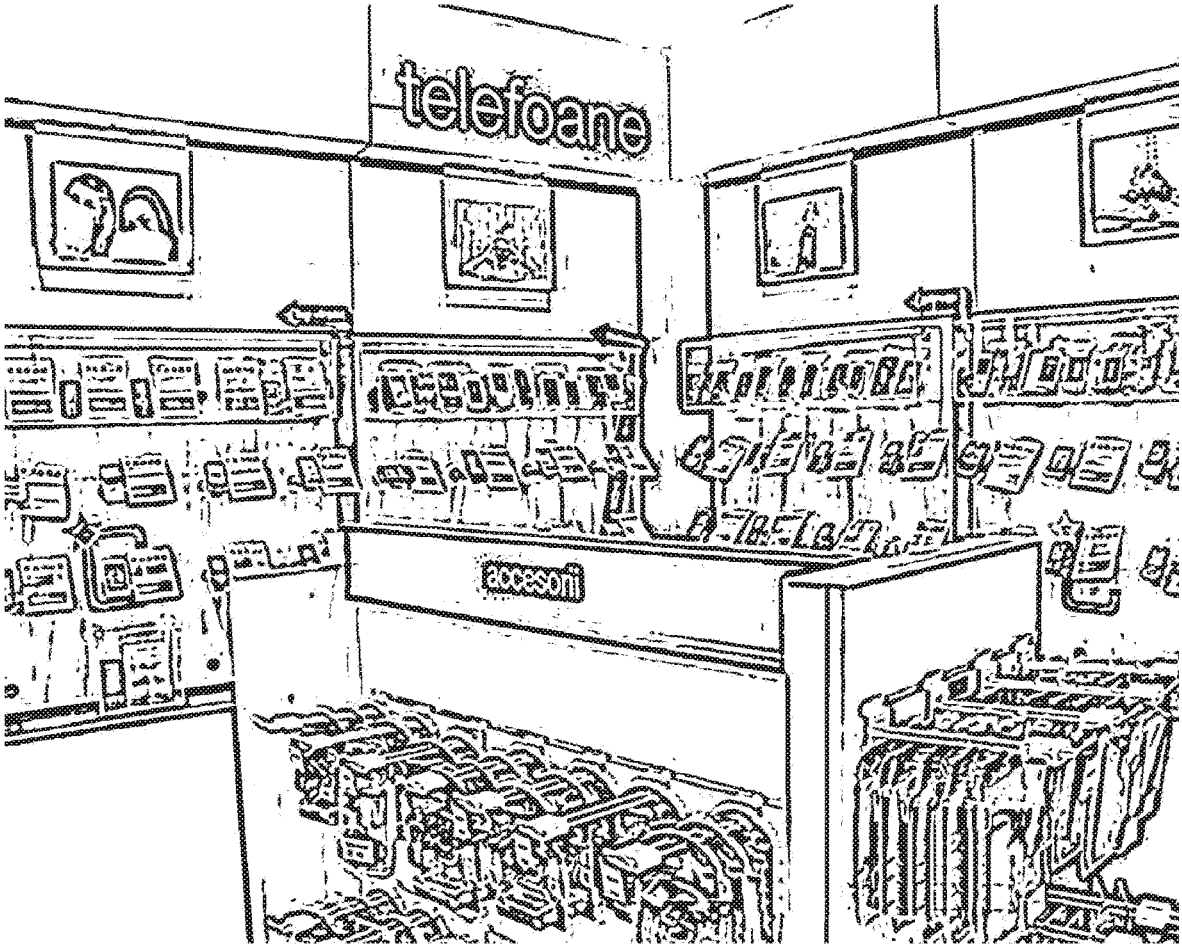
FIG. 1B (PRIOR ART)

An embodiment of the prior art for an existing powered display for lighting fixtures is shown in FIG. 1A. This display requires that the individual products on display all be wired behind the display which requires a trained electrical professional. Once attached, the products cannot be easily removed or interchanged. An embodiment of another existing electronic device display of the prior art is shown in FIG. 1B that displays the electronic device in an unpowered state. This display does not provide power to the products so does not allow the customer to interact with and test out the electronic device. The electronic devices in this type of non-powered display typically provide only a printed sticker on them that adheres to the electronic device's display screen and simulates the look of the display when it is powered on.

Before explaining at least one embodiment of the invention in detail, it is to be understood that the invention is not necessarily limited in its application to the details of construction and the arrangement of the components and/or methods set forth in the following description and/or illustrated in the drawings and/or the embodiments. The invention is capable of other embodiments or of being practiced or carried out in various ways.

Figure 2:
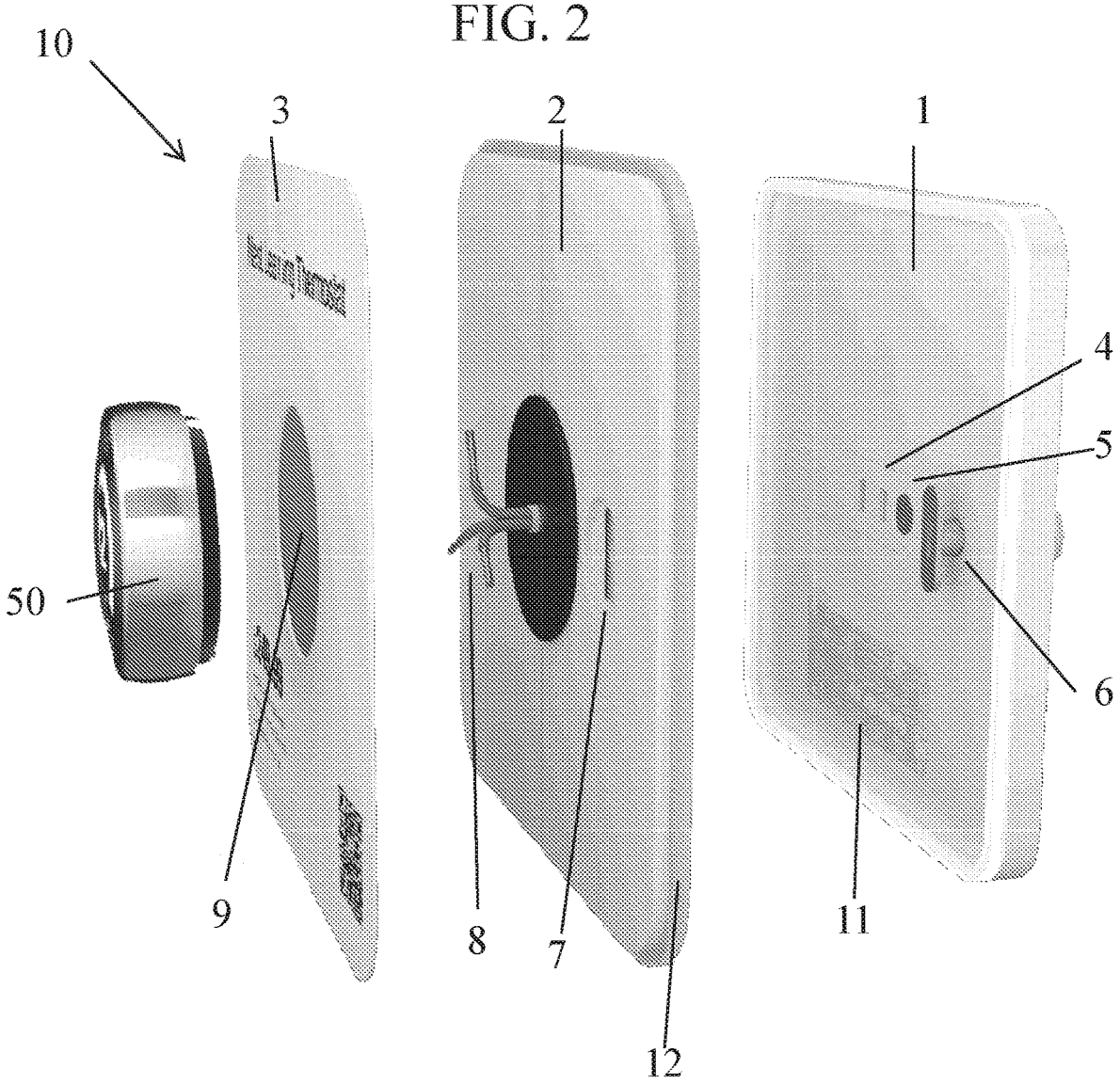
FIG. 2 is an exploded view of an embodiment of the product display system components including a base unit, a modular power adaptor, a product display plate, and an example product in an embodiment of the present invention.

As shown in FIG. 2, the present invention is a product display system 10 that includes a base unit 1, a modular power adaptor 2, and a product display plate 3. In the embodiment shown a product 50 is attached and supported on the product display system 10 by having a rear portion of the product extend through a central area 9 of the product display plate 3. The product 50 is attached using wires 8 to the modular power adaptor 2 to power the product 50. The embodiments of the product display system 10 therefore engage and hold the product 50, typically an electronic device, and provide power to that device in a way that is specific to the power requirements of that device. The product 50 may also be attached to the product display plate 3 using adhesives, screws, snaps, mechanical fasteners, or other attachment fixtures. The product display plate 3 may have printed graphics with a product description, barcodes, purchasing or other ticketing information. The product display plate 3 may be attached to the modular power adaptor 2 magnetically, with adhesive, or by some other means that allows for the product display plate 3 to be changed and have new product information when a new product 50 is installed on the product display system 10.

In the central area 9 where a product 50 may be mounted, wires 8 as shown, or other electrical contacts, connectors or plugs that are appropriate for the power requirements are provided to power the electronics product 50. The modular power adaptor 2 that provides the electrical connection attaches to the base unit 1 electrically via a power supply receptacle 4 and mechanically using a locking shaft 6 that is inserted into a locking shaft slot 7 on the modular power adaptor 2. A microprocessor and other electronic components for the transfer and receiving of data to the product display system from an external controller is provided on an electronic circuit board 11 affixed to the base unit 1. Surrounding the modular power adaptor 2, a lighting system such as a series of LEDs is provided to enhance the display of the product 50 within the product display system 10.

Figure 3:
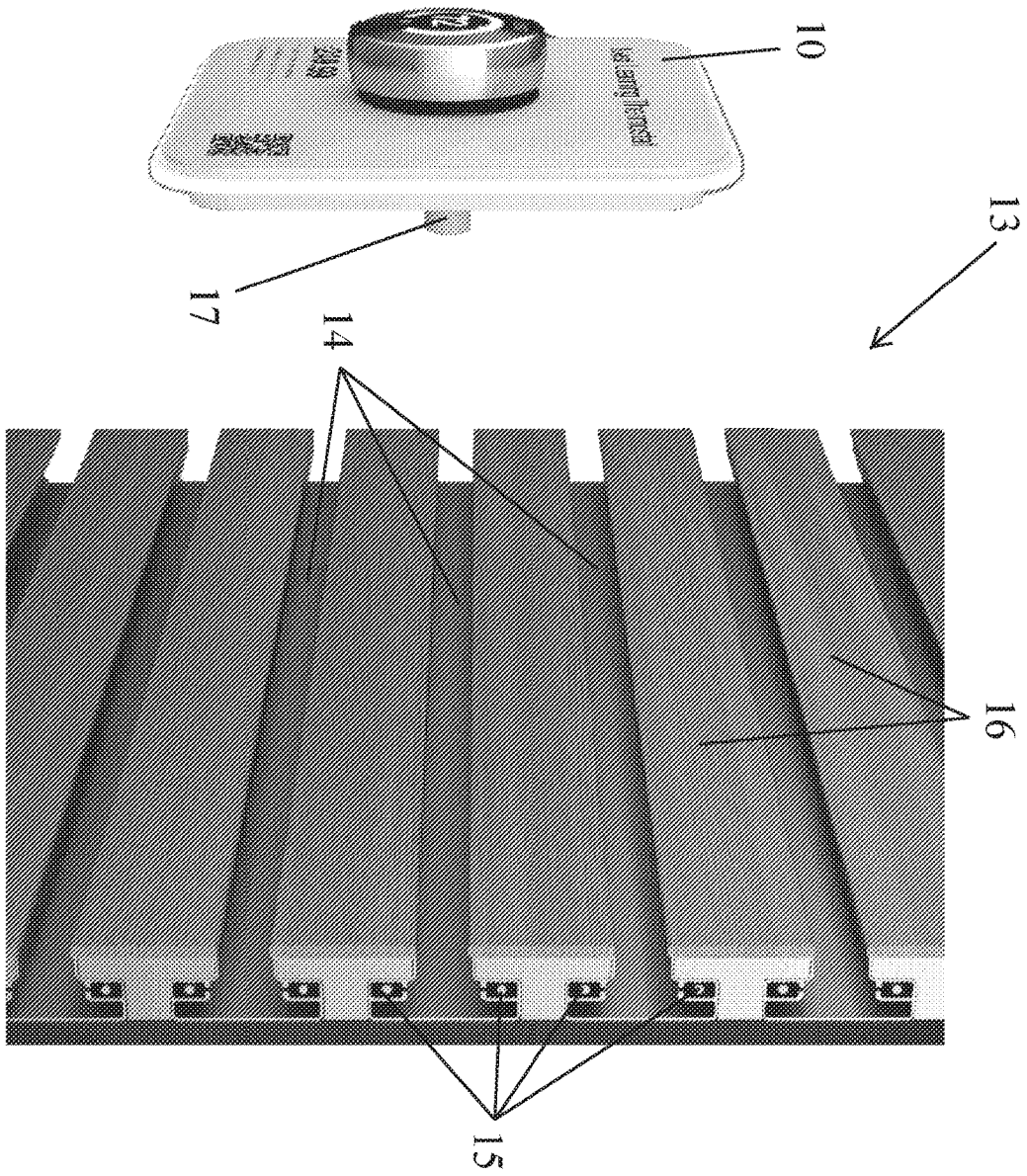
FIG. 3 is a perspective view showing an embodiment of the components from FIG. 2 of the product display system assembled with a display surface having powered slots in an embodiment of the present invention.

As shown in FIG. 3, the base unit 1 is supported on the display surface 13 that has a series of slots 14 that may be equally spaced apart. The display surface 13 may be mounted as a single piece or in sections along a surface or wall so that the wall appears similar to a typical and common slotted wall used to display products at retail locations. In some embodiments, the display surface 13 may be supported on a free-standing unit to display products within aisles in a retail setting. The series of slots 14 are provided to mount the product display system 10 and each slot 14 has one or more power conductors 15 that extend along the length of the slot 14. A finished display surface 16 between each slot 14 provides an attractive backing for displaying the products 50. To mount the product display system 10, the slot support 17 of the base unit 1 is positioned within the powered slot 14.

Figure 4:
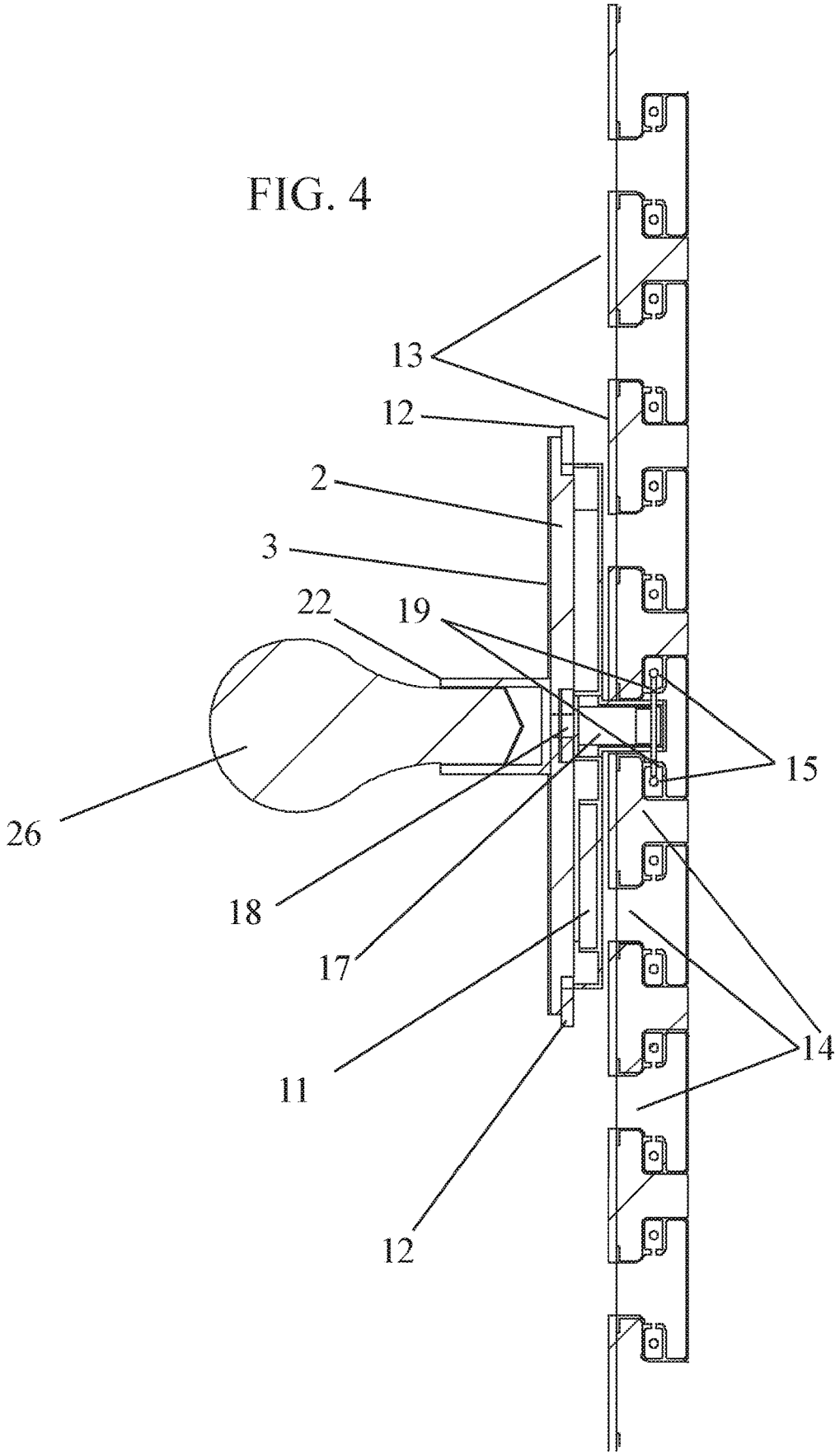
FIG. 4 shows a cross-sectional view of an embodiment of the powered electrical slots of the display surface with the assembled product display system installed in an embodiment of the present invention.

As shown in FIG. 4, on the back of the modular power adaptor 2, electrical contacts 18 are inserted into the power supply receptacle 4 of the base unit 1 and the locking shaft 6 is rotated for example 90 degrees by means of a screwdriver or key. The locking shaft 6 mechanically locks together the modular power adaptor 2 and the base unit 1. The rotation of the locking shaft 6 also rotates electrical contacts 19 of the base unit 1 inside the powered slot 14 and causes the electrical contacts 19 to make an electrical connection with the electrical conductors 15 inside the slot 14 to have the power conductors 15 provide typical alternating current (AC) power at the voltage and frequency of the electrical system of the incoming power supply. The assembled product display system 10 may therefore be slid along the slot 14 to position the product 50 mounted on the product display system 10 in a desired location and be set in an electrical and mechanical locked position along the power conductors 15 to provide power to the product 50 and to the electronic components of the electronic circuit board 11 of the product display system 10.

The powered slots 14 are connected electrically to the building power wiring via a typical electrical plug and receptacle that is rated for the maximum total power of the electronic components mounted on the product display system 10. The electronic circuit board 11 converts the incoming power from the alternating current that is supplied to direct or alternating current sufficient to properly power the electronics product 50 that will be mounted on the product display system 10. The power supplied to the product 50 may be any level of direct or alternating current power that is appropriate for the power requirements of the product 50. The electronic circuit board 11 has components that are arranged into an electrical circuit that is designed to provide the power required by the modular power adaptor 2, illuminate the light channel 12 on the product display plate 3, and power an alarm and speaker that sounds if the product 50 is forcibly removed from the modular power adaptor 2 or if the product display system 10 is removed from the powered slot 14. The electronics circuit board 11 may further send and receive data to and from an external controller to make adjustments such as to colors in lighting, power management, and to report faults within the product display system 10. In further embodiments, the electrical contacts 18 may be connected to a wireless charging antenna on the modular power adaptor 2. The wireless charging antenna transfers electrical power from the modular power adaptor 2 to the product 50.

In some embodiments the product display system 10 contains a light channel 12 that transverses the perimeter of the modular display adaptor 2 and is illuminated by a light source 5 located on the surface of the base unit 1. The light source 5 is in a convenient location on the front of the base unit 1 where the base unit 1 comes in contact with the modular power adaptor 2, and located where the light source 5 is not visible when the modular power adaptor 2 is connected to the base unit 1. When powered on, the light channel 12 on the modular power adaptor 2 is illuminated. In FIGS. 5A and 5B, an embodiment of the front and back of the product display system 10 is shown in an illuminated configuration with the product display plate 3 having product information. In FIGS. 5C and 51), the embodiment of the light channel 12 is powered off so the product display system 10 is in a non-illuminated configuration.

Figure 6A:
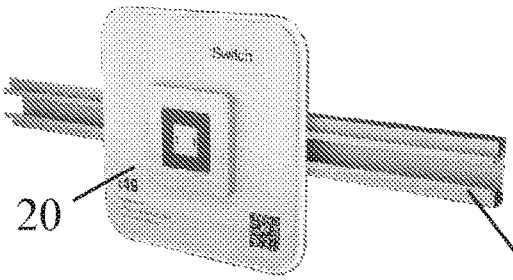
FIGS. 6A-6H show different embodiments of the modular power adaptor of the power display system including AC and DC power distributed with a variety of connectors for the purpose of providing electrical power to receptacles, light bulbs, and other electronic devices attached for display to the product display system.
Figure 6B:
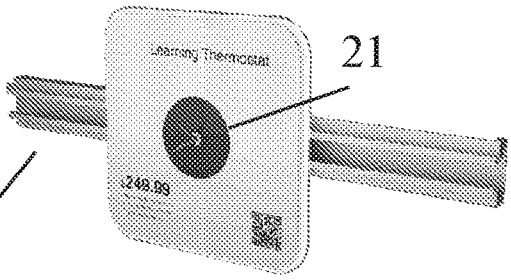
Figure 6C:
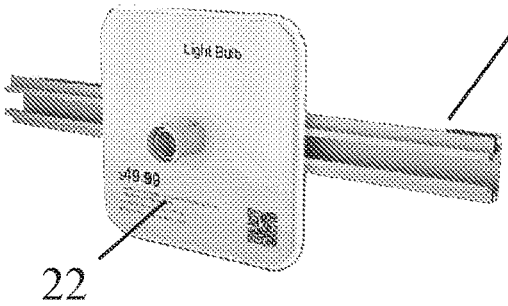
Figure 6D:
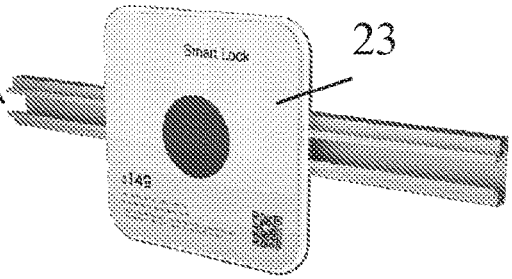
Figure 6E:
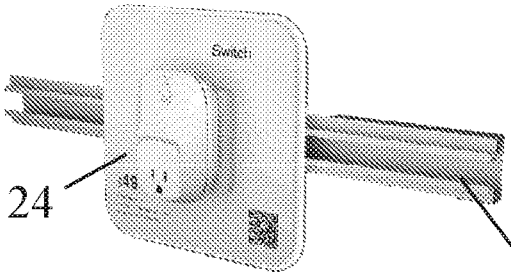
Figure 6F:
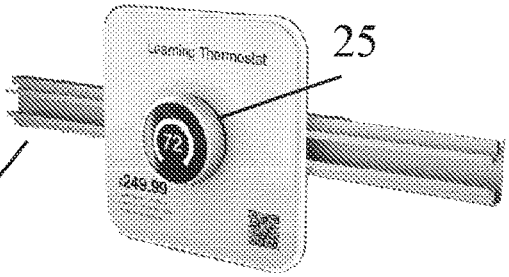
Figure 6G:
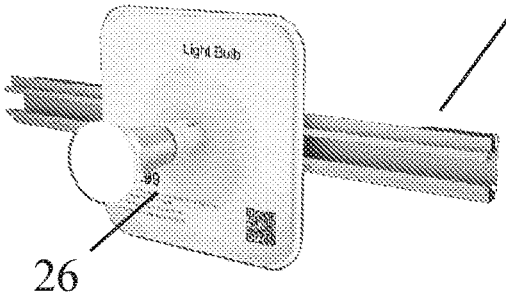
Figure 6H:
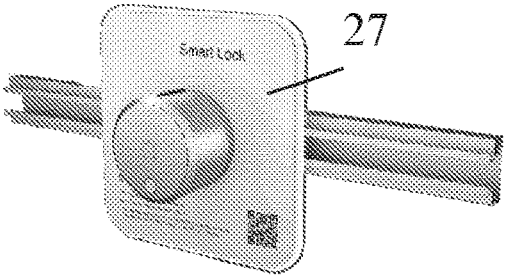

A plurality of different embodiments of electrical connectors that are electrically connected to the modular power adaptor 2 including connectors that use either AC or DC power are shown in FIGS. 6A-6H. The variety of connectors are for the purpose of providing electrical power to receptacles, light bulbs, and other electronic devices mounted on the product display system 10. As shown in FIG. 6A, a plug connector 20 may be provided or electrical wires 21, as shown in FIG. 6B, a socket 22, as shown in FIG. 6C, and a magnetic connector 23, as shown in FIG. 61) are some of the possible types of connectors that may electrically connect and support a product 50 on the product display system 10. As shown in FIG. 6E, a switch 24 is connected using the plug connector 20, a thermostat 25 is connected using the electrical wires 21, a light bulb 26 is connected using the socket 22, and a smart lock 27 is connected using the magnetic connector 23. The modular design of the product display system 10 provides for any type of connector to be attached to the modular power adaptor 2 and be interchangeable within the product display system 10 to power or mount a different type of product 50.

Figures 7A, 7B:
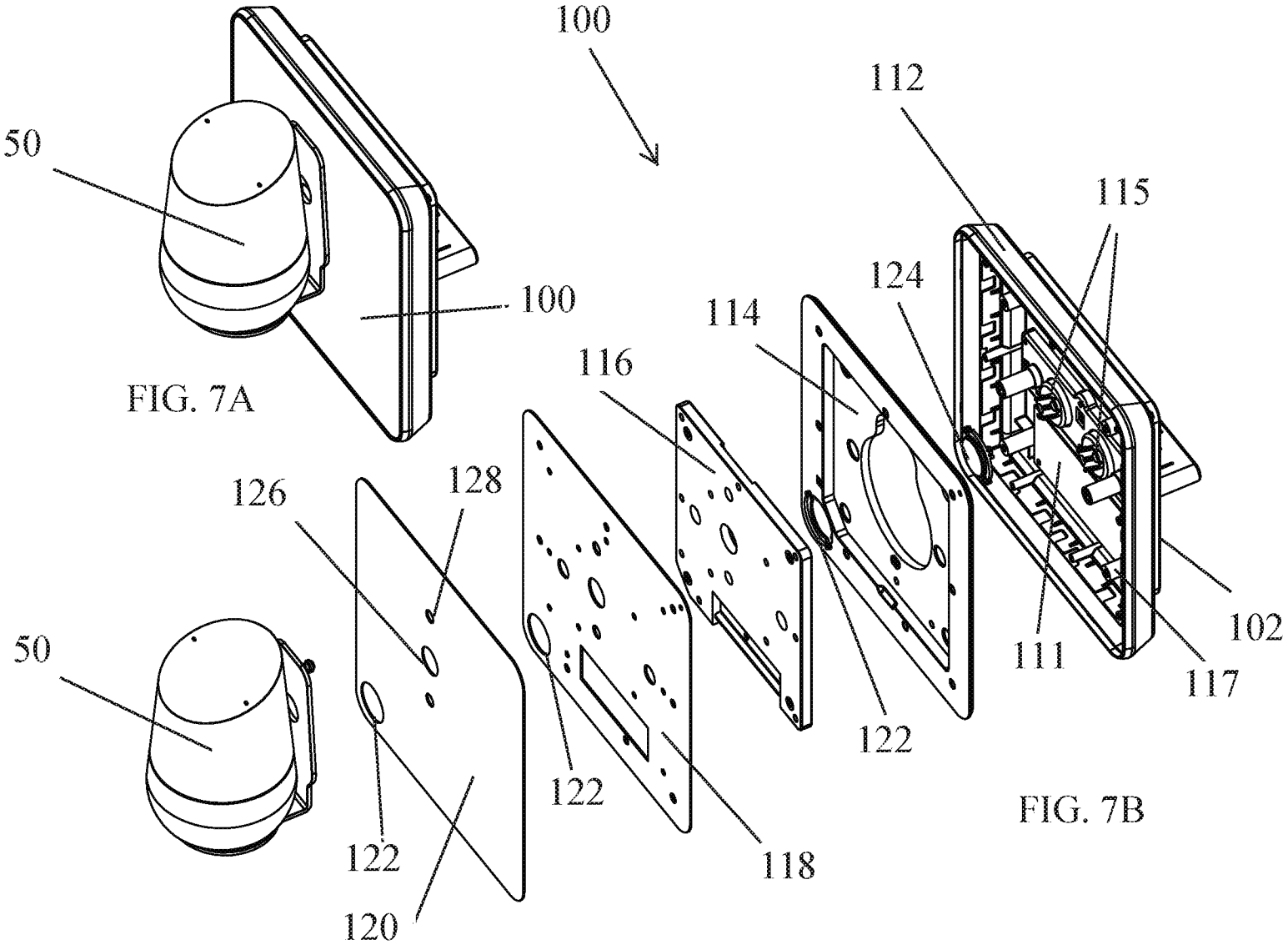
FIG. 7A shows a perspective view of another embodiment of the product display system of the present invention with a product installed.
FIG. 7B shows an exploded view of the embodiment of product display system of FIG. 7A with a product.

The modularity is shown in a further embodiment of the product display system 100 in FIGS. 7A and 7B. In this embodiment, the product display system 100 is similarly square in shape, however the product display system may be in any shape that is suitable and of any materials, weight and dimension as required for by the products 50 that are supported for display. In the exploded view shown in FIG. 7B, any of the components may be switched to provide proper product description information, mounting and electrical power requirements as needed for the products 50 being displayed. The components of the product display system 100 are a rear housing 102 that serves as a base unit 1 by attaching to a display surface 113 and as a modular power adaptor 2 by providing appropriately conditioned power to products 50 attached to the product display system. The rear housing 102 has an electronic circuit board 111 installed, a lighting channel 112, and locking mechanisms 115 that provide for both the electrical and mechanical attachment of components to the rear housing 102. A rear housing cover 114 is provided to protect the electronic circuit board 111 and support a mounting plate 116 that may be of plastic or other suitable material. The electronic circuit board 111 comprising conversion circuitry to convert standard AC power supplied to different levels of AC power at different frequencies, or to provide DC power at various voltage and current combinations. The mounting plate 116 is replaceable within the product display system 100 to accommodate posts and screw hole alignments that may vary on different products 50. By simply switching the mounting plate 116, a wide variety of products 50 may be attached to the product display system 100 without having to remove the rear housing 102 from a display surface 113. A metallic or partially metallic cover 118 is provided to enclose the rear housing 102. In some embodiments, posts 117 extend from the rear housing 102, through the rear housing cover 114 and mounting plate 116 to be attached to the metallic cover 118 using screws, snaps, or other fasteners. A flexible plate 120 is removably affixed magnetically or using adhesives to provide for changing product description and purchasing information easily when a different product 50 is attached to the product display system 100. An opening 122 may be provided in the components to provide for a button or other controller 124 to be attached to the rear housing 102 to turn the product display system 100 on and off and adjust lighting, electrical power requirements and other settings. In some embodiments, the product display system 100 may have an audio and video display to provide product information, issues alerts and alarms, and receive and transmit information from and to the external controller.

Figure 8A:
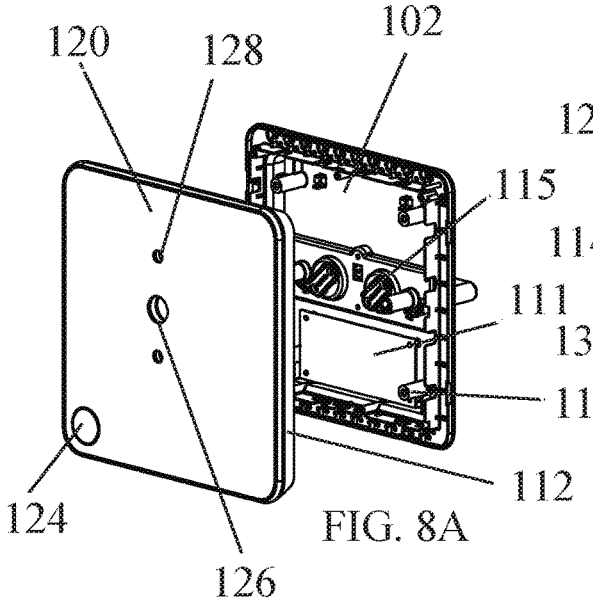
FIG. 8A is a perspective view from the front of the front display components assembled and the rear housing of the embodiment of the product display system of FIG. 7A.
Figure 8B:
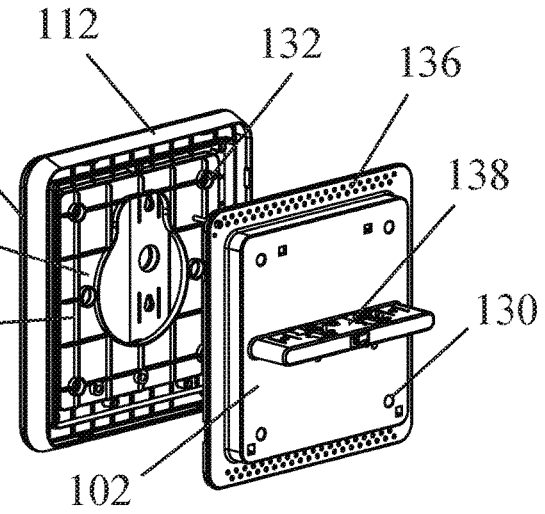
FIG. 8B is a perspective view from the back of the front display components assembled and the rear housing of the embodiment of the product display system of FIG. 7A.
Figure 8C:
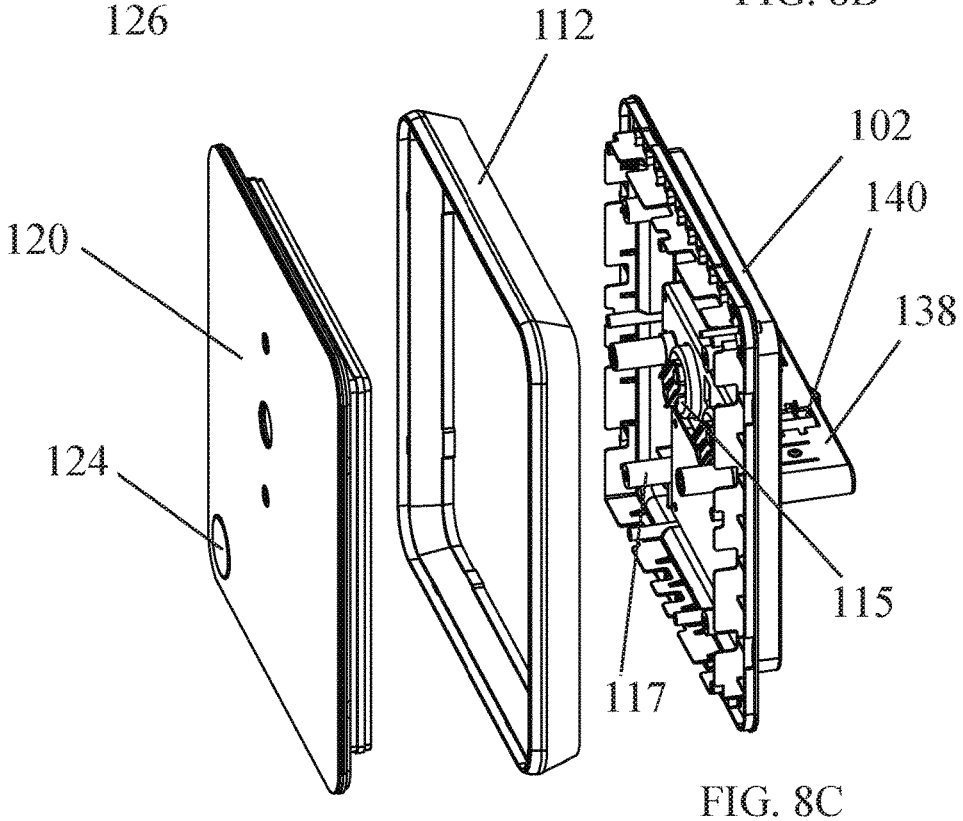
FIG. 8C is a side perspective view of the front display components assembled, lighting, and the rear housing of the embodiment of the product display system of FIG. 7A.
Figure 10A:
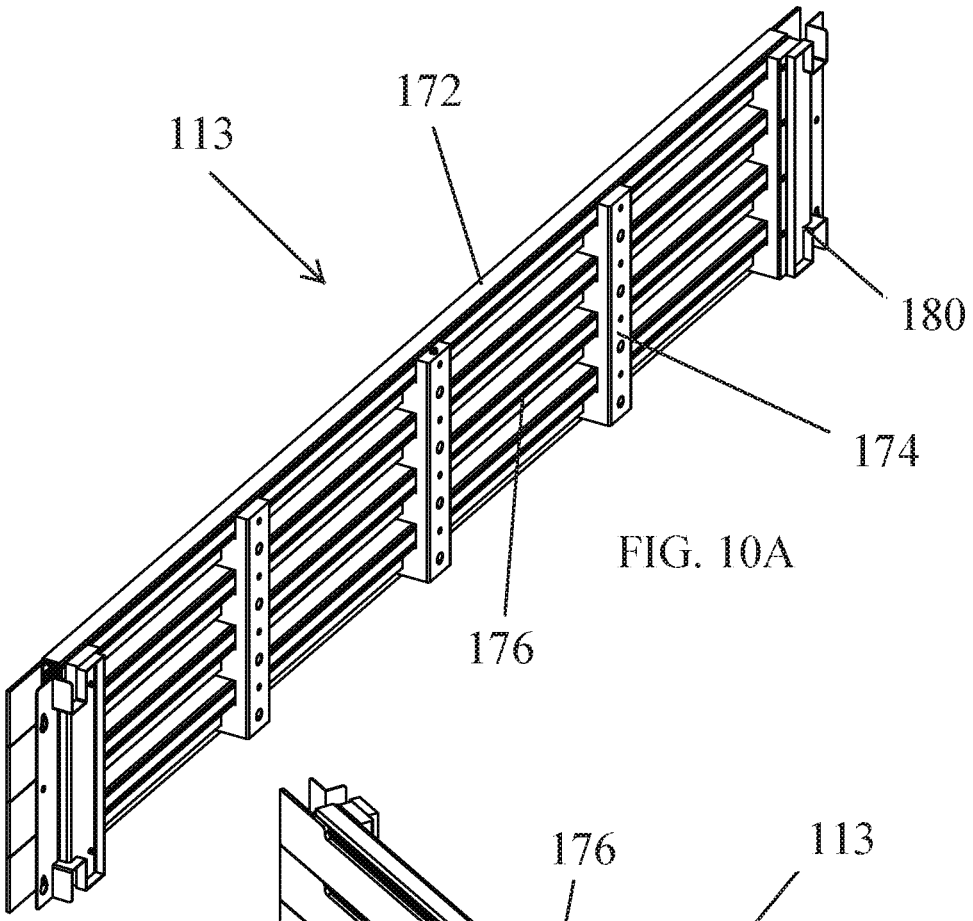
FIG. 10A is a rear perspective view of an embodiment of a section of the display surface in an embodiment of the product display system of the present invention.

As shown in FIG. 8A, openings 126 and 128 that extend through the components are provided to have electrical wires, cables or connectors from the rear housing 102 be accessible to attach and power a product 50 mounted on the product display system 100. As shown in FIG. 8B, the flexible, magnetic plate 120, the metallic cover 118 and mounting plate 116 may be snap-fit or otherwise attached to the rear housing cover 114 and then using screws or other attachment fixtures inserted through openings 130 in the rear housing 102 and openings 132 in the rear housing cover 114 be attached as a unit to the rear housing 102. The rear housing cover 114 may have gridded standoffs 134 and ventilation holes 136 may be provided to keep the electronic circuit board 111 cool. A slot support 138 having electrical contacts 140 as shown in FIG. 8C is provided on the rear housing 102 for attachment to a display surface 113, as shown in FIG. 10A.

Figures 9A, 9B:
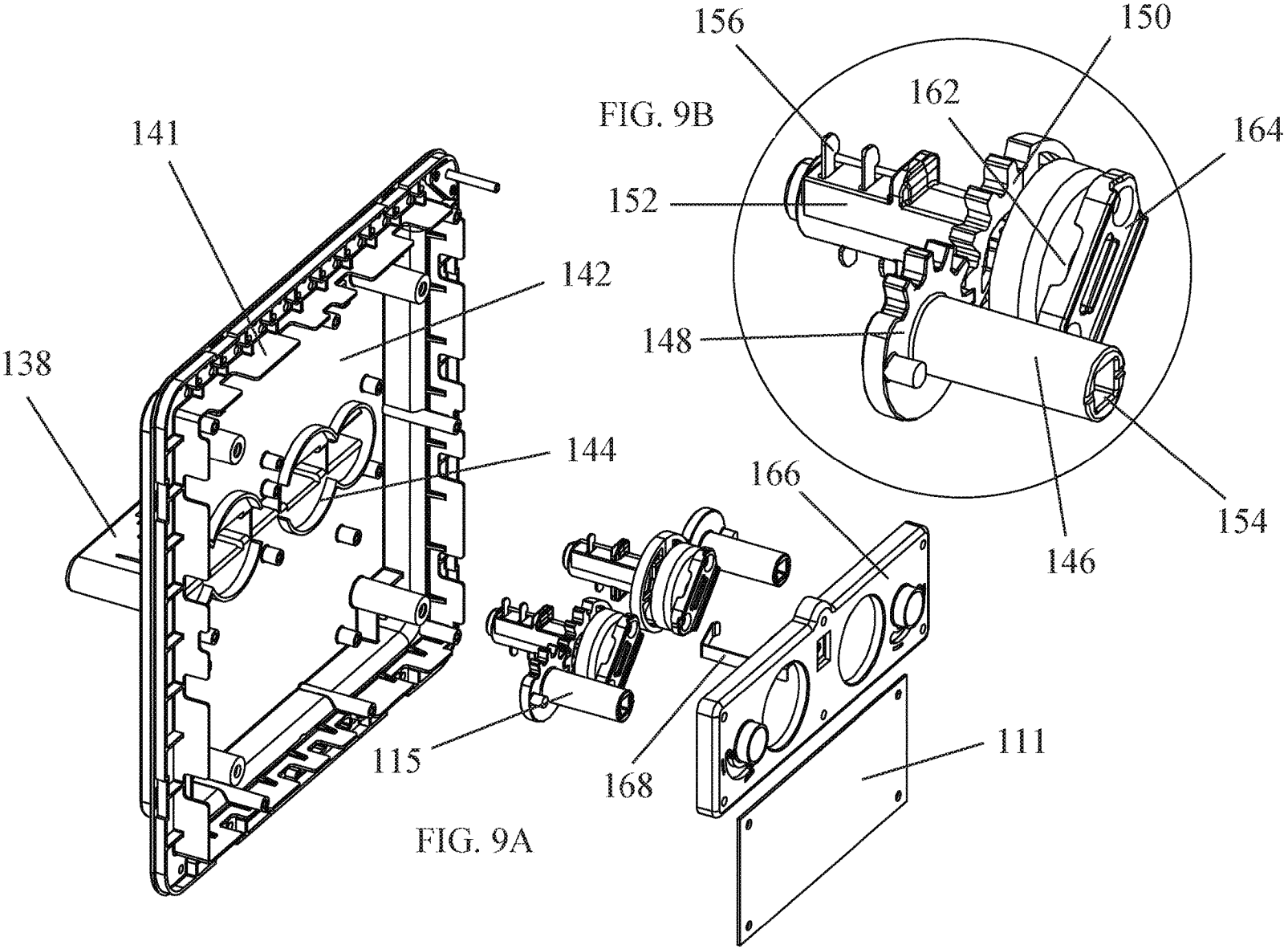
FIG. 9A is an exploded view of an embodiment of the components of the rear housing including locking mechanisms in an embodiment of the product display system of the present invention.
FIG. 9B is an inset of a front view of an embodiment of the locking mechanism in an embodiment of the product display system of the present invention.
Figure 10B:
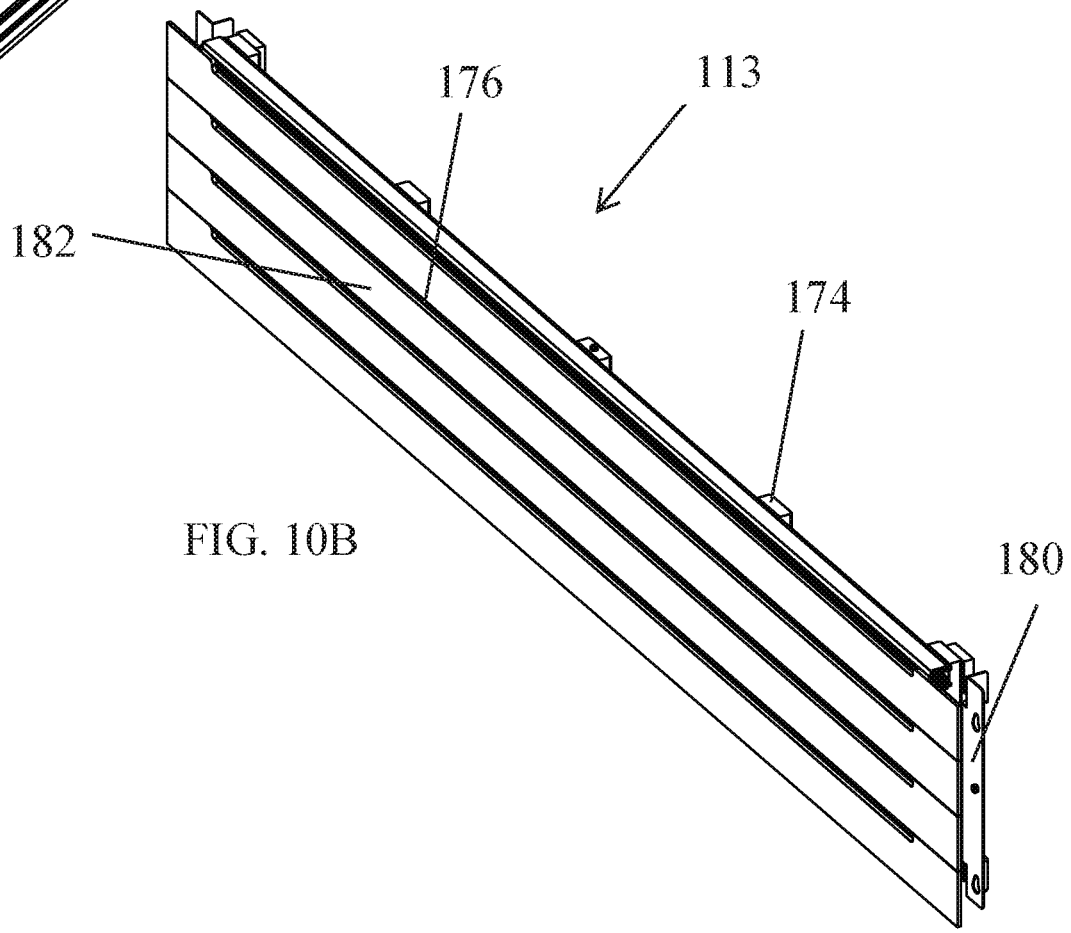
FIG. 10B is a front perspective view of an embodiment of a section of the display surface in an embodiment of the product display system of the present invention.
Figure 10C:
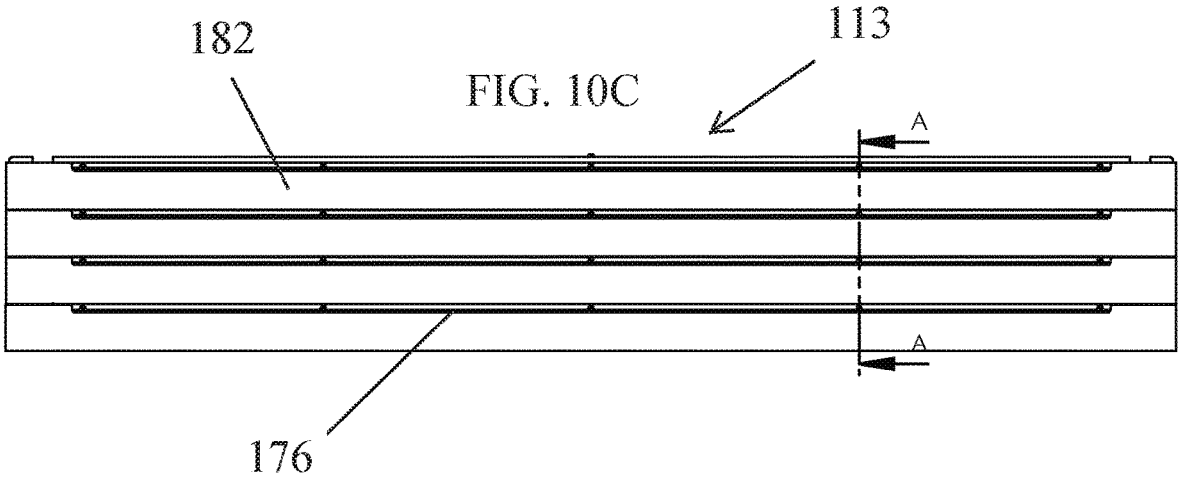
FIG. 10C is a side elevation view of an embodiment of a section of the display surface in an embodiment of the product display system of the present invention.
Figure 10D:
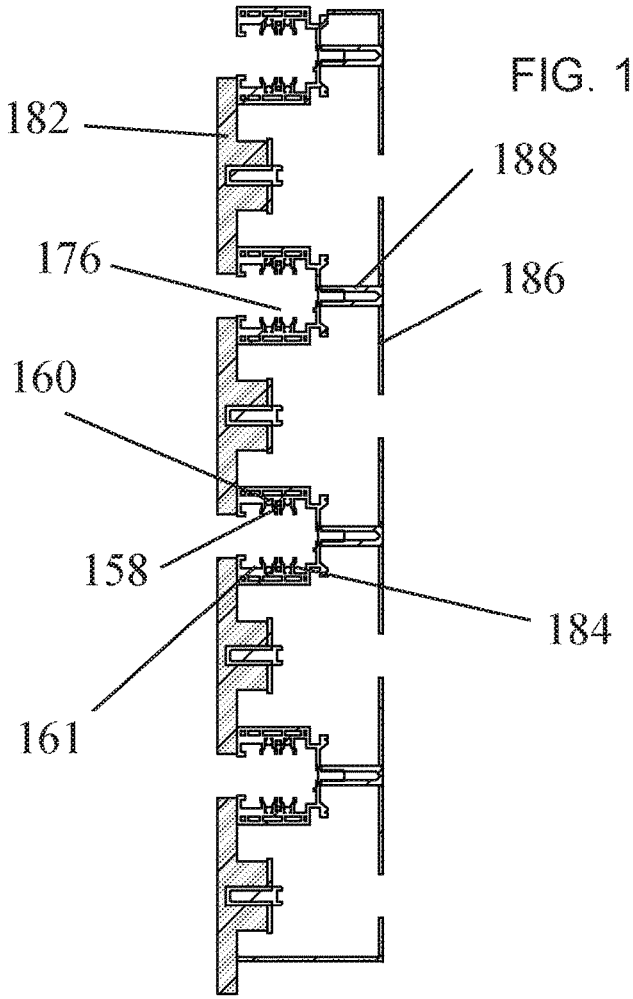
FIG. 10D is a cross-sectional view of an embodiment of a section of the display surface in an embodiment of the product display system of the present invention.

As shown in FIG. 9A in an exploded view of the rear housing 102, tabs 141 may be provided to align and secure the rear housing 102 to the rear housing cover 114. The rear panel 142 of the rear housing 102 has dual-circular openings 144 for supporting and positioning a locking pin 146 of the locking mechanism 115 to enmesh a locking pin gear 148 with a contact pin gear 150 to rotate a contact pin 152. The locking pin 146 is rotated by inserting a key, screwdriver, or Allen wrench into a pin insert 154 and turning the locking pin 146 approximately 90 degrees to engage electrical contacts 156 in conductor contact points 158 along the conductors 160 of the display surface 113, as shown in FIG. 10D. The electrical contacts 156 have wires (not shown) that extend along and out of the body of the contact pin 152 and through a widened opening 162 having a cap 164 to guide the wires and provide strain relief. A mechanical latch 153 that is also rotated with the contact pin 152 extends into a channel 161 in the slot 176 to secure the product display system 100 to the display surface 113, as shown in FIG. 10D. A support plate 166 that is affixed to the rear panel 142 provides for the rotation of the pins and gears in the locking mechanism 115. The electrical circuit board 111 is also attached to the rear panel 142 and is electrically connected using wires or solder connections to the locking mechanisms 115. The electrical circuit board 111 is grounded by a ground pin 168 extending from the support plate 166 out and through the rear panel 142 to a ground along the conductors 160 in the display surface 113.

Figure 9C:
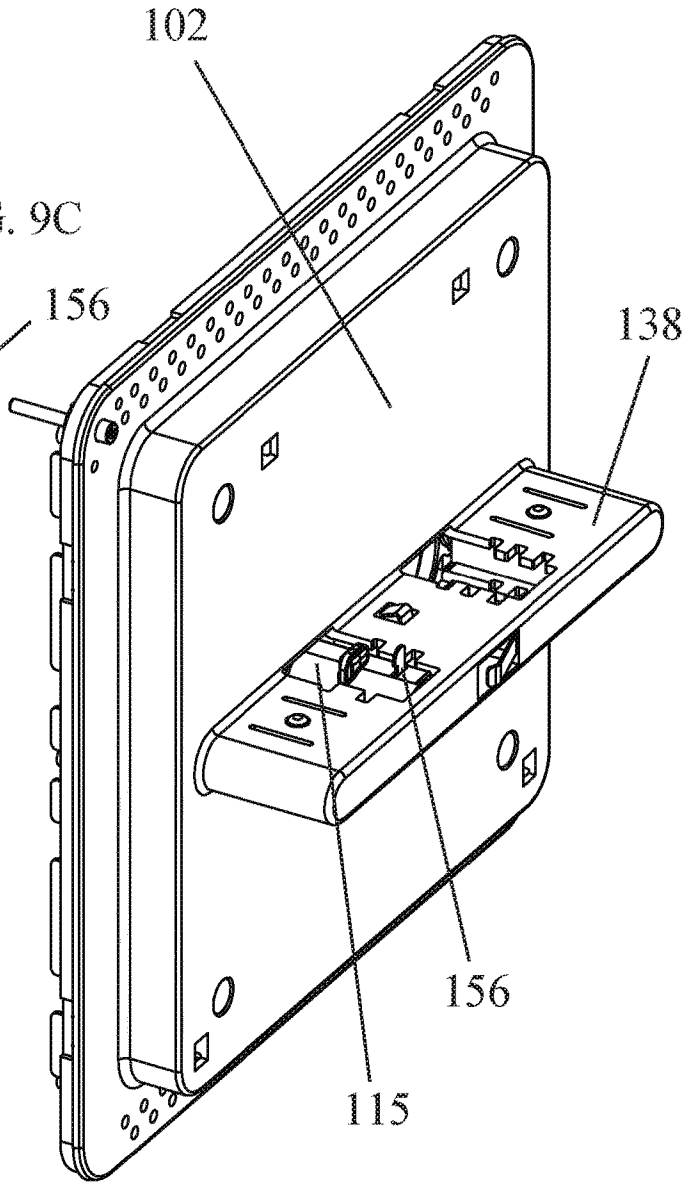
FIG. 9C is an exploded view of an embodiment of the attachment of the locking mechanisms to the rear housing in an embodiment of the product display system of the present invention.
Figure 9D:
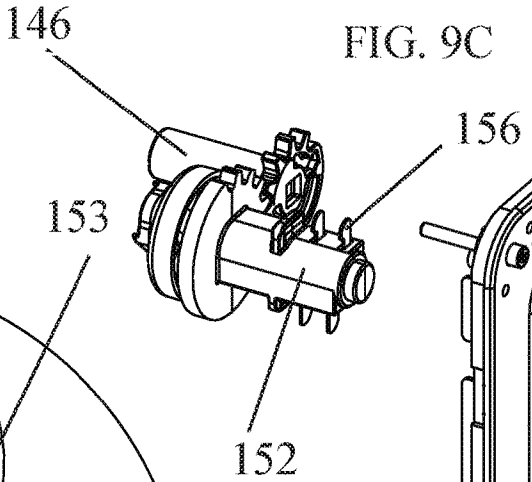
FIG. 9D is an inset of a rear view of an embodiment of the locking mechanism in an embodiment of the product display system of the present invention.
Figure 9D:
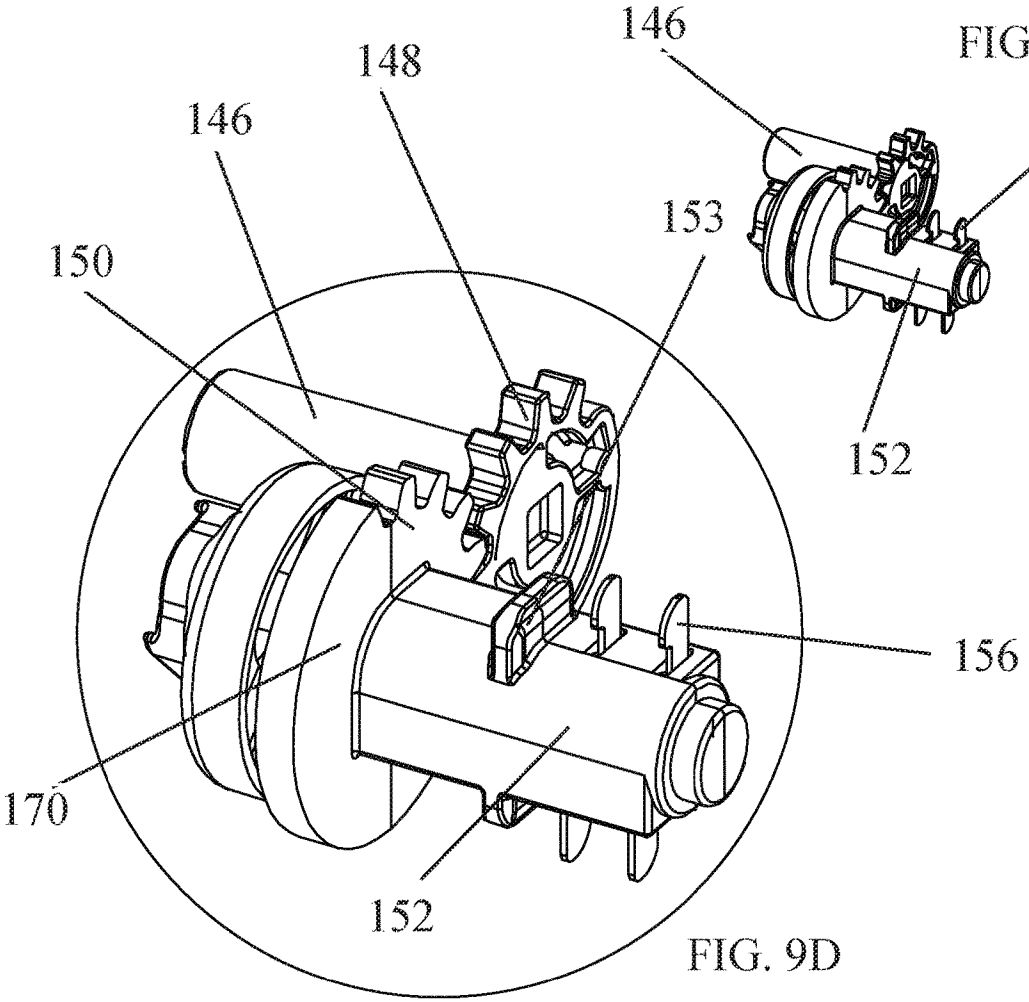

A rear view of the rear housing 102 showing a locking mechanism 115 attached with the electrical contacts 156 extended after rotation of the locking mechanism 115 is shown in FIG. 9C. A housing 170 is provided to protect the gears 148 and 150 that are shown with the housing 170 cut away. As shown in FIG. 10A, the display surface 113 is constructed from preformed channels 172 that are aligned and attached to posts 174 to form the slots 176 that have the electrical conductors 160. The display surface 113 may be manufactured in sections that are then interconnected in any number or configuration to set the display surface 113 to a desired size and shape to accommodate the products for display. The sections are stacked using interlocking rails 180 formed at the corners of each end of a section. The outer surface 182. As shown in FIG. 10B may be flat with decorative designs and colors. A side elevation view showing an embodiment of the display surface 113 with equal spacing between each slot 176 is shown in FIG. 10C. As shown in a cross-sectional view in FIG. 10D, each slot 176 provides contact with the conductors 160 using clips 184 along the top and bottom of the slot 176. A set of brackets 186 are provided to attach the display surface 113 to a wall or free-standing surface and ground supports 188 that are connected to an electrical ground are provided for insertion of the ground pin 168.

Figure 11A:
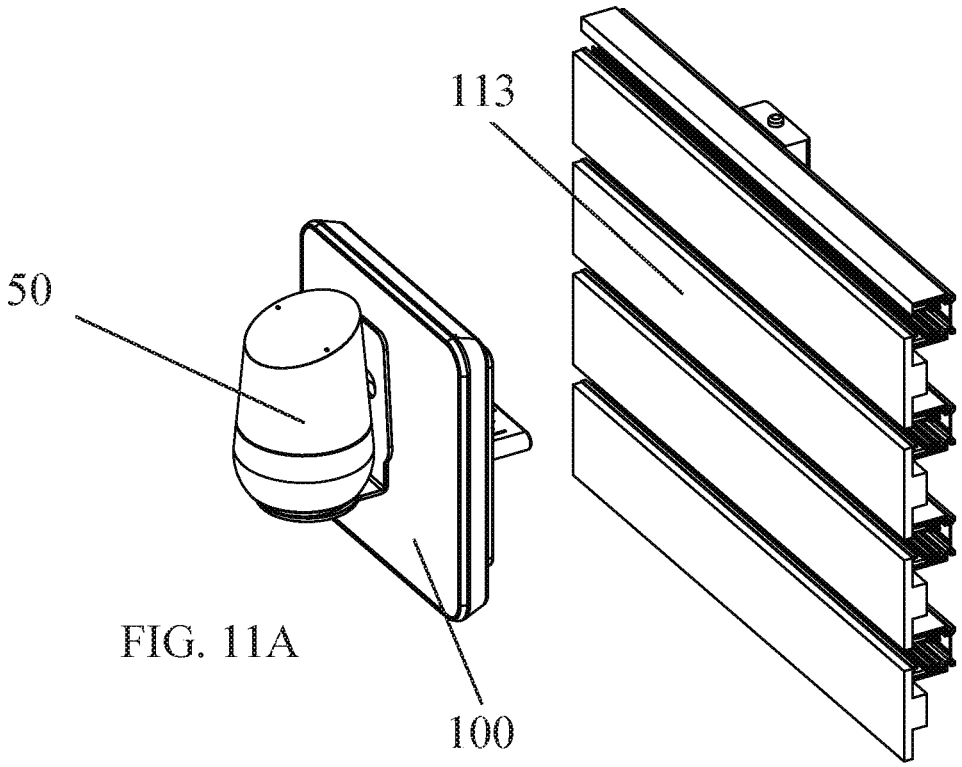
FIG. 11A is a perspective view of an embodiment of the product display system and a section of the display surface in an embodiment of the present invention.
Figure 11B:
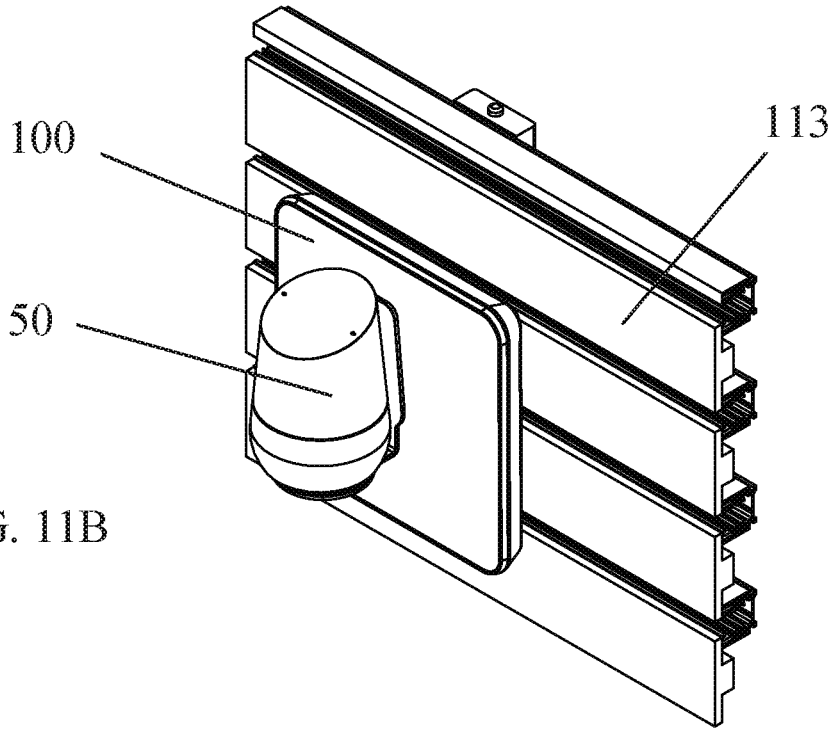
FIG. 11B is a front perspective view of an embodiment of the product display system installed on a section of the display surface in an embodiment of the present invention.
Figure 11C:
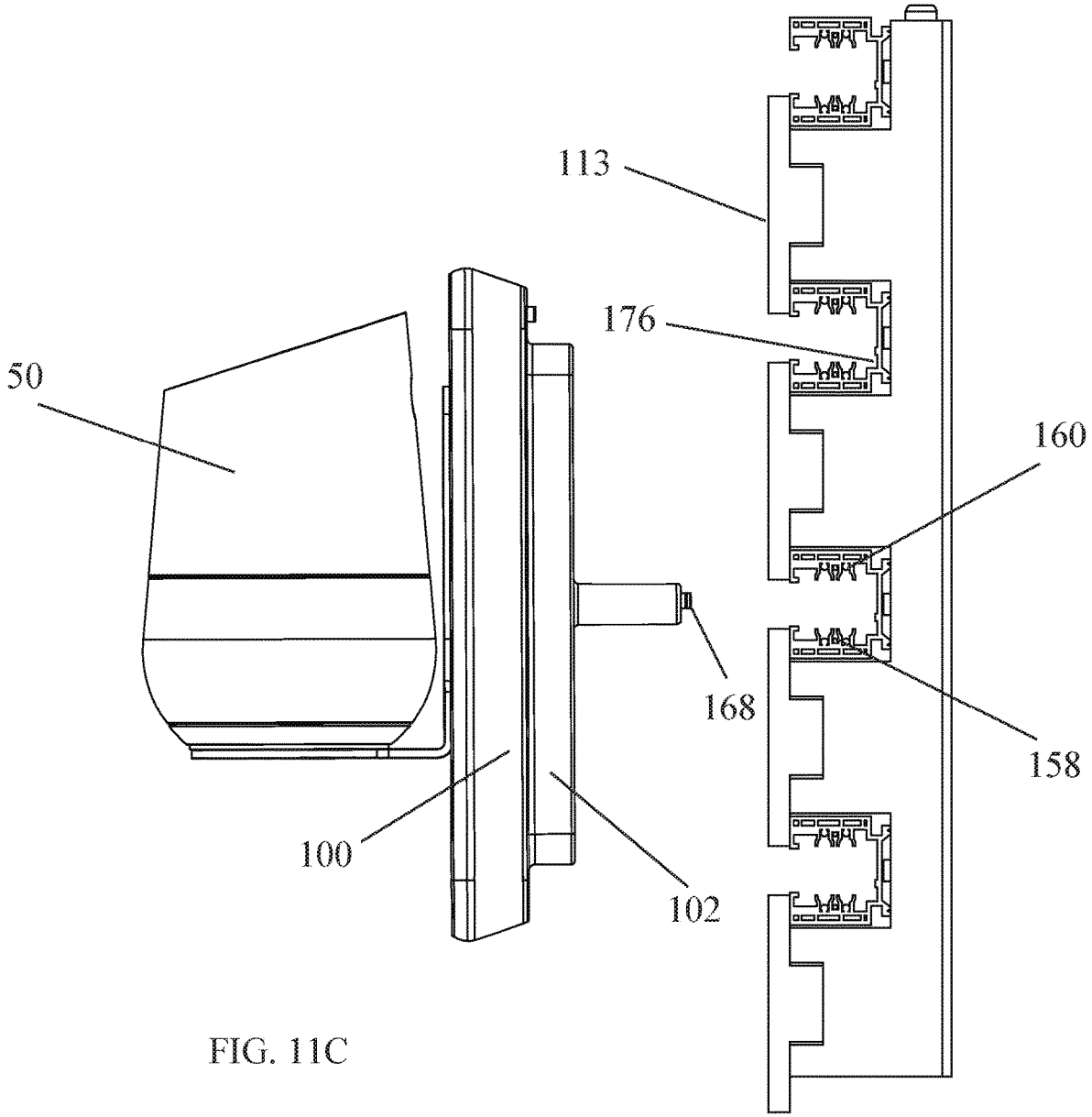
FIG. 11C is a side elevation view of an embodiment of the product display system and a section of the display surface in an embodiment of the present invention.
Figure 11D:
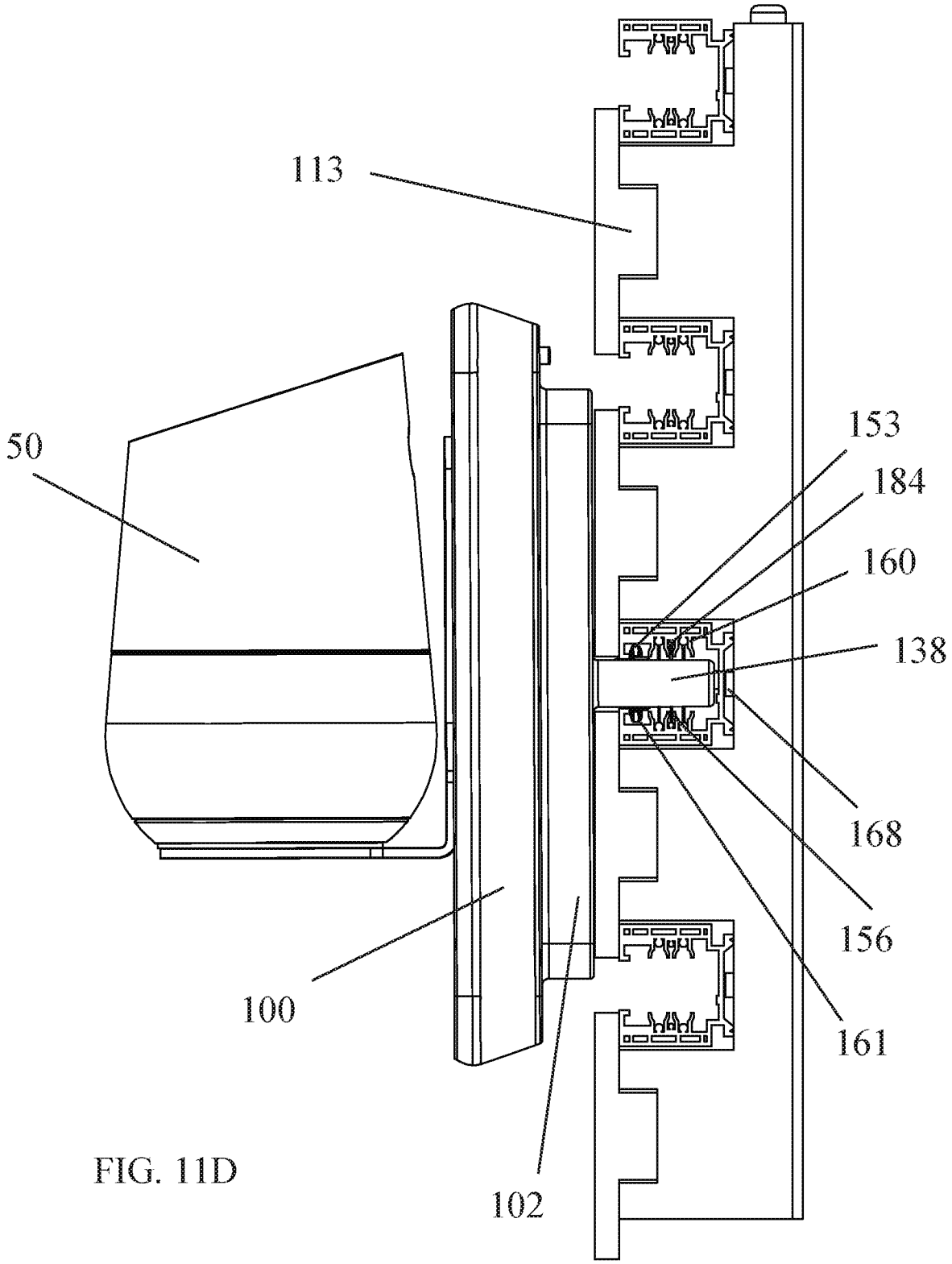
FIG. 11D is a side elevation view of an embodiment of the product display system installed on a section of the display surface in an embodiment of the present invention.

The alignment of the product display system 100 to the display surface 113 is shown in a perspective view in FIG. 11A and the attachment with the slot support 138 inserted in a slot 176 is shown in FIG. 11B. A cross-sectional view of the alignment of the product display system 100 to the display surface 113 is shown in FIG. 11C. The mechanical latch 153 and electrical contacts 156 are not extended until as shown in FIG. 11D, the locking mechanism 115 is rotated and the mechanical latch 153 extends into the channel 161 and the contact pins 156 extend into the clips to maintain electrical contact between the contact pins 156 and the conductors 160.

Figures 12A, 12B, 12C, 12D:
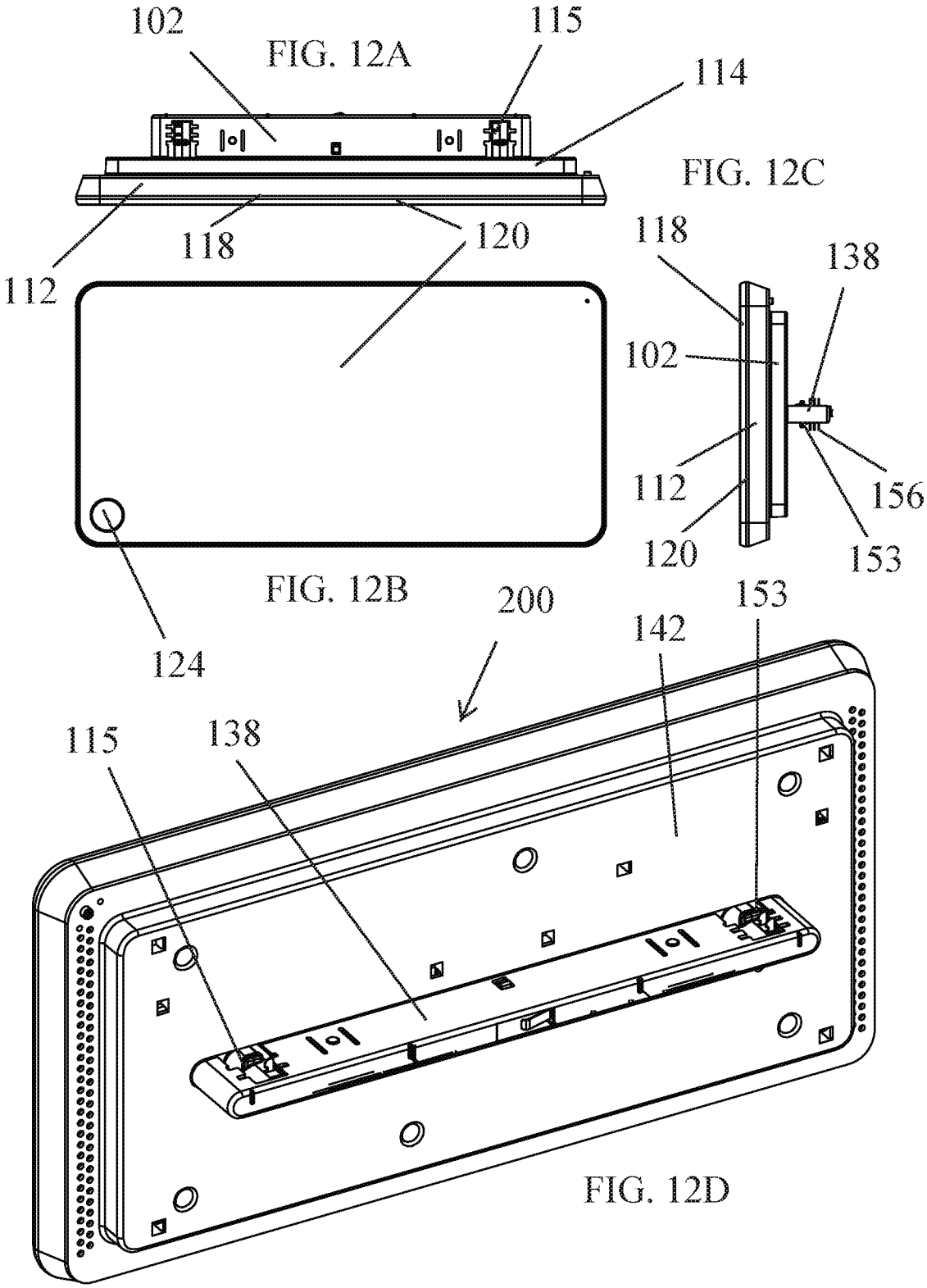
FIG. 12A is a side view of a further embodiment of the product display system of the present invention.
FIG. 12B is a front view of a further embodiment of the product display system of the present invention.
FIG. 12C is a side elevation view of a further embodiment of the product display system of the present invention.
FIG. 12D is a perspective view of a further embodiment of the product display system of the present invention.

In a further embodiment of the product display system 200, the shape is rectangular providing greater surface area for larger products 50 such as cell phones or tablet computers. The components of the further embodiment are similar with the same numbers used to indicate similar components. As shown in a side view in FIG. 12A, the locking mechanisms 115 may be spaced further apart and closer to the ends to provide greater support and stability to the product display system 200. A front elevation view is shown in FIG. 12B and a side elevation view is shown in FIG. 12C. The extended distance between the locking mechanisms 115 along the slot support 138 is shown in FIG. 12D. In some embodiments, additional electrical contacts 156 may be provided to install and power more than one electronics product 50 within the product display system 200.

Figure 13A:
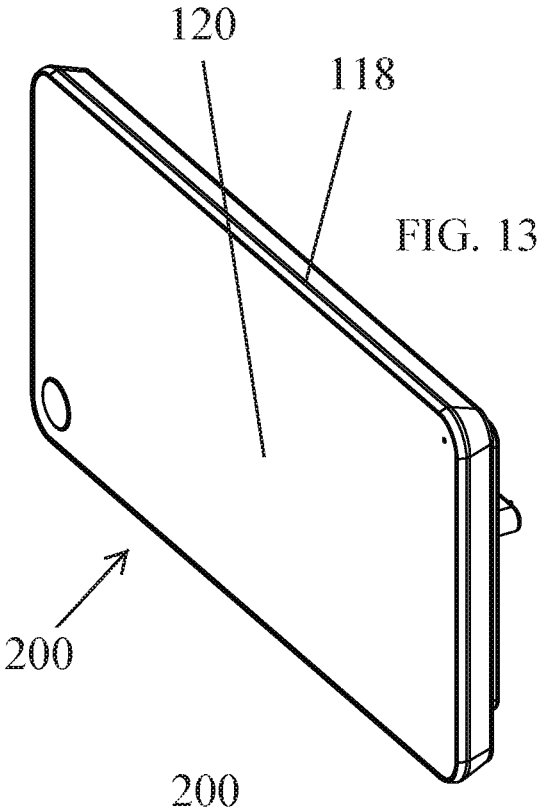
FIG. 13A is a perspective view of the further embodiment of the product display system of FIGS. 12A-12D with an embodiment of a flexible magnetic graphic plate attached in an embodiment of the present invent.
Figure 13B:
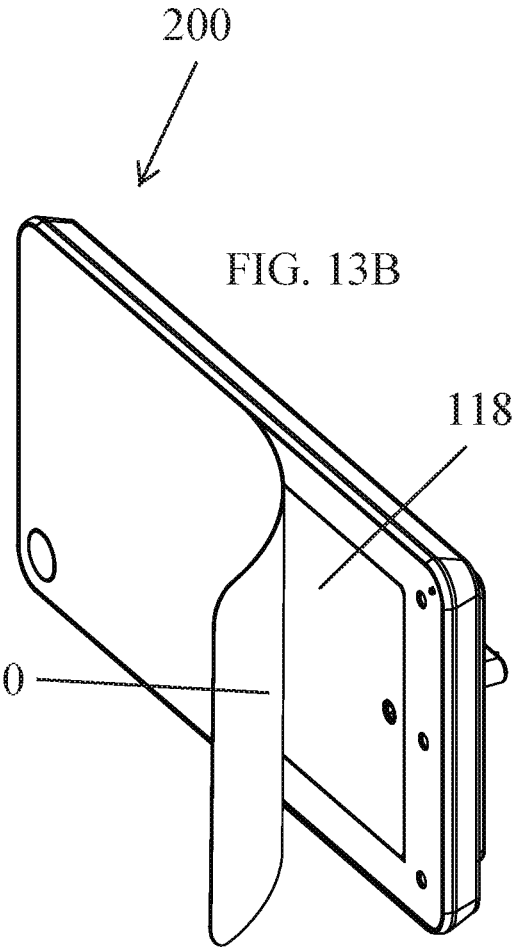
FIG. 13B is a perspective view of the further embodiment of the product display system of FIGS. 12A-12D with the flexible magnetic graphic plate pulled back exposing an embodiment of a mounting plate in an embodiment of the present invention.
Figure 13C:
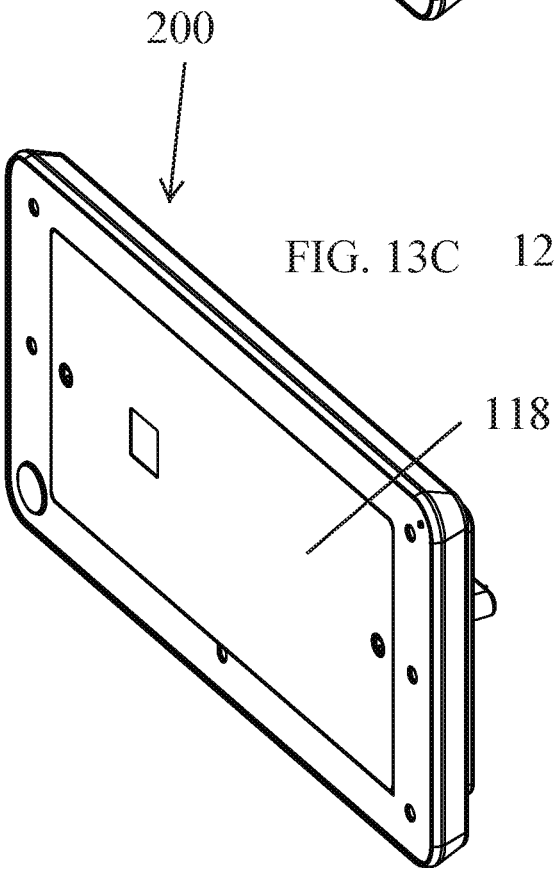
FIG. 13C is a perspective view of the further embodiment of the product display system of FIGS. 12A-12D with the flexible magnetic graphic plate removed showing the mounting plate in an embodiment of the present invention.

An embodiment of the flexible, magnetic plate 120 is shown attached to the product display system 200 in FIG. 13A and partially removed by pulling the flexible material up and away from the metallic cover 118 is shown in FIG. 13B. The flexible, magnetic plate 120 is completely removed in FIG. 13C. By removing and replacing the flexible, magnetic plate 120 when a product is replaced in the product display system 200 a fast and efficient way to present product and purchasing information is provided with the added benefit of quickly replacing old products with new without additional wiring or construction to provide power to the new products 50.

Figure 14A:
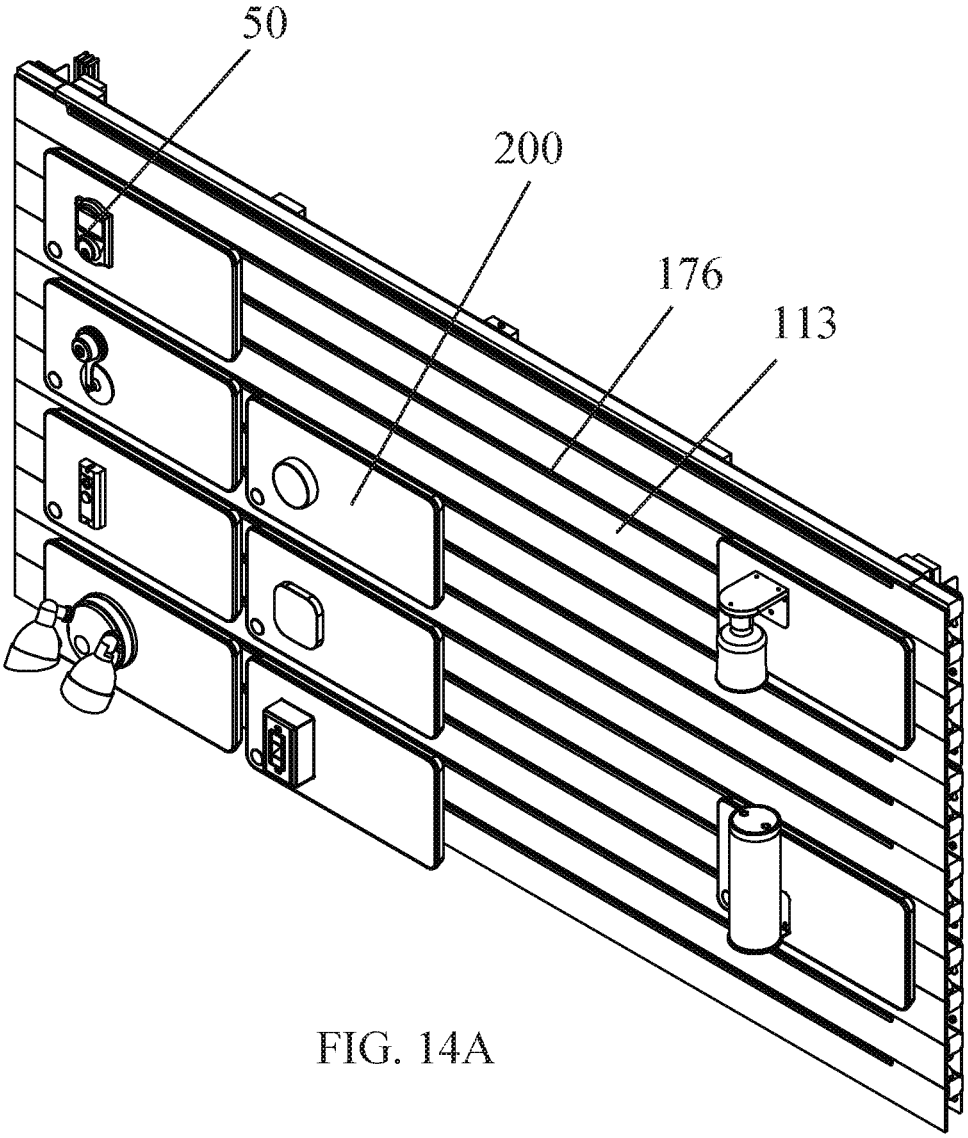
FIG. 14A is a perspective view from the front of an embodiment of a plurality of product display systems installed on a display surface in an embodiment of the present invention.
Figure 14C:
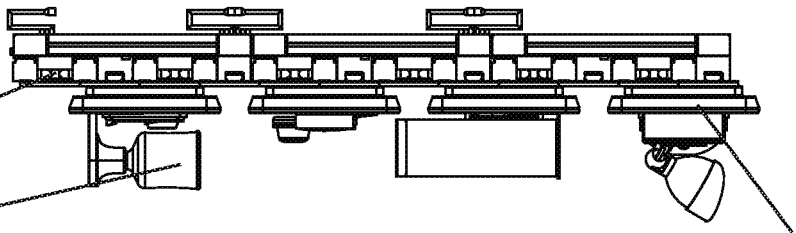
FIG. 14C is a side elevation view of an embodiment of a plurality of product display systems installed on a display surface in an embodiment of the present invention.
Figure 14B:
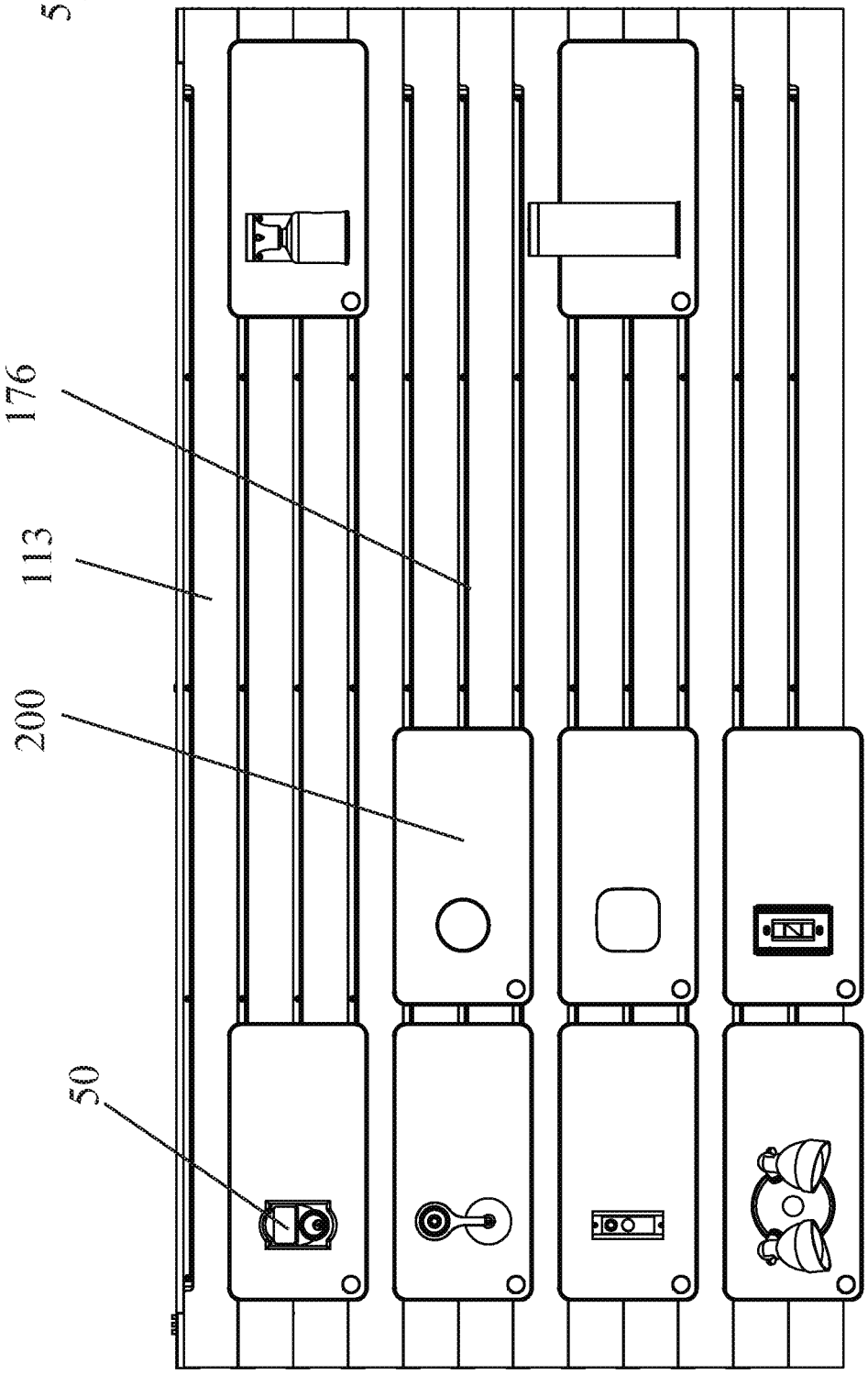
FIG. 14B is a front elevation view of an embodiment of a plurality of product display systems installed on a display surface in an embodiment of the present invention.

As shown in FIG. 14A, the product display system 20 provides for many different types and styles of products 50) having different power requirements, connectors, and mounting configurations to all be installed on the display surface 113 and be powered to provide for a user to operate the product 50 and see its features and functions. As shown in FIG. 14B, the products 50 may be placed anywhere along the slots 176 and be easily moved or replaced as needed. The side elevation view in FIG. 14C shows how each product display system 200 is mounted within the slots 176 to receive appropriate power to operate the product 50 and to receive data related to display settings and product information to best utilize space and enhance products 50 to better sell them in a retail environment.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. A modular product display system, comprising:

a display surface having a plurality of slots each slot having powered conductors;

a base unit having at least one electrical contact within a slot support, the slot support configured for insertion in one of the plurality of slots to have the at least one electrical contact make an electrical connection with the powered conductors;

a modular power adaptor configured to electrically connect one of a plurality of different types of electrical connectors to the base unit;

a mechanical locking mechanism configured to rotate and secure the base unit to one of the plurality of slots configured to provide power, the locking mechanism having electrical contacts that are rotated with the rotation of the locking mechanism to make contact with the Dowered conductors of one of the plurality of slots configured to provide power to both mechanically and electrically connect the base unit to the display surface; and wherein the modular display system is configured to provide appropriately conditioned power for a product through the attachment of the at least one electrical contact of the base unit to the powered conductors of one slot of the plurality of slots and the attachment of the product to one of the plurality of different types of electrical connectors connected through the modular power adaptor to the base unit and display surface.

2. The modular product display system of claim 1 comprising a product display plate removably affixed to the modular power adaptor; and wherein the modular display system is configured to provide appropriately conditioned power for a plurality of products through the attachment of electrical contacts of each of a plurality of base units to the powered conductors of one slot of one of the plurality of slots and the attachment of each of the plurality of products to one of the plurality of different types of electrical connectors connected through one of a plurality of product display plates, to one of a plurality of modular power adaptors connected to one of the plurality of base units and to the display surface.

3. The modular product display system of claim 1 comprising an electronic circuit board, the circuit configured to transmit and receive data.

4. The modular product display system of claim 1 comprising a metallic cover.

5. The modular product display system of claim 1 comprising a plurality of replaceable mounting plates, each having a specific alignment of posts and screw holes to mate with a product's mounting configuration.

6. The modular product display system of claim 1 wherein the product display plate is of a flexible material.

7. The modular product display system of claim 1 wherein the product display plate is magnetic.

8. The modular product display system of claim 1 wherein the product display plate comprising at least one from a group consisting of pnnted graphics, product descriptions, barcodes, purchasing information and other ticketing information.

9. The modular product display system of claim 1 wherein the plurality of different types of electrical connectors are replaceable within the modular power adaptor, each having a specific configuration to mate with a product's electrical connector requirements.

10. The modular product display system of claim 1 comprising an electrical conversion circuit configured to convert standard AC power supplied to different levels of AC power at different frequencies, or to provide DC power at various voltage and current combinations to match a product's power requirements.

11. The modular product display system of claim 1 comprising lighting.

12. The modular product display system of claim 2 comprising a security system that sounds an audible alarm when an electrical disconnection between the product and the modular product display system or between the modular product display system and the powered conductors within the slot are detected.

13. The modular product display system of claim 1 comprising a wireless charging antenna that transfers electrical power to the product wirelessly using a conventional wireless standard such a "Qi" or using another, wireless power transfer protocol.

14. The modular product display system of claim 1 comprising a standard electrical outlet on the product display plate that can be used to power electrical products or electrical components within the product display system.

* * * * *